US012759108B2

(12) United States Patent
Kabasawa et al.

(10) Patent No.: US 12,759,108 B2
(45) Date of Patent: Oct. 13, 2026

(54) POLISHING METHOD, AND POLISHING APPARATUS

(71) Applicant: EBARA CORPORATION, Tokyo (JP)

(72) Inventors: Masashi Kabasawa, Tokyo (JP); Toshimitsu Sasaki, Tokyo (JP); Yoichi Shiokawa, Tokyo (JP); Keita Yagi, Tokyo (JP); Yuki Watanabe, Tokyo (JP); Nachiketa Chauhan, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 365 days.

(21) Appl. No.: 18/554,643

(22) PCT Filed: Jan. 17, 2022

(86) PCT No.: PCT/JP2022/001361

§ 371 (c)(1),
(2) Date: Oct. 10, 2023

(87) PCT Pub. No.: WO2022/224508

PCT Pub. Date: Oct. 27, 2022

(65) Prior Publication Data

US 2024/0181594 A1 Jun. 6, 2024

(30) Foreign Application Priority Data

Apr. 19, 2021 (JP) ..... 2021-070194

(51) Int. Cl.
*B24B 37/015* (2012.01)
*B24B 37/013* (2012.01)
(Continued)

(52) U.S. Cl.
CPC ..... *B24B 37/015* (2013.01); *B24B 37/013* (2013.01); *B24B 49/04* (2013.01); *B24B 49/14* (2013.01)

(58) Field of Classification Search
CPC ..... B24B 37/015; B24B 37/20; B24B 37/042; B24B 37/107; B24B 37/005; B24B 37/013; B24B 37/10; B24B 55/02; B24B 49/14
See application file for complete search history.

(56) References Cited

U.S. PATENT DOCUMENTS 6,244,944 B1 * 6/2001 Elledge ..... B08B 3/022 451/299
2002/0061713 A1 5/2002 Mikhaylich et al.
(Continued)

FOREIGN PATENT DOCUMENTS

CN 1703769 A 11/2005
CN 102376565 A 3/2012
(Continued)

OTHER PUBLICATIONS

International Search Report issued in Patent Application No. PCT/JP2022/001361 dated Mar. 8, 2022.

*Primary Examiner* — Joel D Crandall
(74) *Attorney, Agent, or Firm* — Chrisman Gallo Tochtrop LLC

(57) ABSTRACT

The present application relates to a polishing method and a polishing apparatus for polishing a substrate, such as a wafer, while pressing the substrate against a polishing surface of a polishing pad, and more particularly to a polishing method and a polishing apparatus for polishing a substrate while regulating a polishing load based on measurement values of a film-thickness measuring device. The polishing method includes: controlling a temperature of a polishing surface of a polishing pad to a predetermined temperature by use of a pad-temperature regulating apparatus; and polishing a substrate while controlling a polishing load for pressing the substrate against the polishing surface
(Continued)

based on measurement values from a film-thickness measuring device provided in the polishing pad.

6 Claims, 18 Drawing Sheets

(51) Int. Cl.
*B24B 49/04* (2006.01)
*B24B 49/14* (2006.01)

(56) References Cited

U.S. PATENT DOCUMENTS

| | | | | |
|---|---|---|---|---|
| 2007/0243795 | A1 | 10/2007 | Kobayashi et al. | |
| 2008/0268751 | A1* | 10/2008 | Yokoyama | B24B 49/12 451/8 |
| 2017/0239778 | A1* | 8/2017 | Maruyama | B24B 37/20 |
| 2018/0236631 | A1* | 8/2018 | Eto | B24B 49/14 |
| 2019/0126428 | A1* | 5/2019 | Maruyama | F28G 1/166 |
| 2020/0001427 | A1* | 1/2020 | Soundararajan | B24B 57/02 |
| 2020/0101579 | A1 | 4/2020 | Suzuki | |
| 2020/0391342 | A1* | 12/2020 | Kabasawa | B24B 37/015 |

FOREIGN PATENT DOCUMENTS

| | | | |
|---|---|---|---|
| CN | 207171777 | U | 4/2018 |
| JP | 2007-292724 | A | 11/2007 |
| JP | 2007-331108 | A | 12/2007 |
| JP | 2009-302577 | A | 12/2009 |
| JP | 2012-148376 | A | 8/2012 |
| JP | 2017-148933 | A | 8/2017 |
| JP | 2020-053550 | A | 4/2020 |

* cited by examiner

POLISHING METHOD, AND POLISHING APPARATUS

TECHNICAL FIELD

The present invention relates to a polishing method and a polishing apparatus for polishing a substrate, such as a wafer, while pressing the substrate against a polishing surface of a polishing pad, and more particularly to a polishing method and a polishing apparatus for polishing a substrate while regulating a polishing load based on measurement values of a film-thickness measuring device.

BACKGROUND ART

A CMP (Chemical Mechanical Polishing) apparatus is a polishing apparatus which is used in a process of polishing a surface of a substrate, such as a wafer, in the manufacturing of a semiconductor device. The CMP apparatus is configured to hold and rotate the substrate with a polishing head, and press the wafer against a polishing pad on a rotating polishing table to polish the surface of the substrate. During polishing, a polishing liquid (or slurry) is supplied onto the polishing pad, so that the surface of the substrate is planarized by a chemical action of the polishing liquid and a mechanical action of abrasive grains contained in the polishing liquid.

When polishing substrates in the CMP apparatus, it is important to accurately detect changes in state of a surface of substrate in order to detect a polishing endpoint of the substrate, and in order to control polishing conditions for the substrate. For example, excessive polishing or insufficient polishing with respect to a target polishing endpoint directly leads to product-defects, and therefore, an amount of polishing needs to be strictly controlled. Accordingly, some CMP apparatuses include a film-thickness measuring device that measures a film thickness of a substrate while polishing the substrate (see, for example, Patent Document 1). This film-thickness measuring device is installed, for example, in the polishing table, and generates film-thickness signals indicating the film thicknesses in a plurality of areas of the substrate each time the polishing table makes one revolution. When the film thickness of the substrate, indicated by the film thickness signal, reaches a predetermined target thickness, the CMP apparatus instructs the polishing head and the polishing table to terminate polishing of the substrate.

The polishing head has an elastic membrane, which forms a plurality of pressure chambers for pressing the substrate against the polishing pad, in a lower portion thereof. When pressurized fluid, such as compressed air, is supplied into each pressure chamber, the substrate is pressed against the polishing pad by fluid pressure through the elastic membrane. The fluid pressure supplied to each pressure chamber is determined by the film thickness of each area in the substrate, which is measured by the film thickness measuring device. For example, the fluid pressure supplied to each pressure chamber (i.e., a polishing load of the substrate against the polishing pad) is controlled based on Preston's law that a polishing rate is proportional to a pressing force for pressing the substrate against the polishing pad. Specifically, when the polishing rate intends to be increased, the fluid pressure is increased, while when the polishing rate intends to be decreased, the fluid pressure is decreased. With this configuration, the pressing force that presses the substrate against the polishing pad can be regulated for each area of the substrate, so that the entire surface of the substrate is polished to a uniform thickness.

CITATION LIST

Patent Literature

Patent document 1: Japanese laid-open patent publication No. 2017-148933

SUMMARY OF INVENTION

Technical Problem

However, temperature of the polishing pad gradually rises during polishing of the substrate due to frictional heat generated by pressing the rotating substrate against the rotating polishing pad. The polishing rate of a substrate depends not only on the polishing load of the substrate against the polishing pad, but also on the surface temperature of the polishing pad. The reason for this is that the chemical action of the polishing liquid with respect to the substrate depends on the temperature.

FIG. 20A is a view showing an example of relationship between a polishing rate and a polishing temperature during polishing of a substrate at a predetermined polishing load, and FIG. 20B is a view showing another example of relationship between a polishing rate and a polishing temperature during polishing of a substrate at a predetermined polishing load. In FIGS. 20A and 20B, a vertical axis represents polishing rate, and a horizontal axis represents polishing temperature (with respect to temperature of the surface of the polishing pad). The graphs shown in FIGS. 20A and 20B illustrate the relationship between the polishing rate and the polishing temperature when the substrate is being polished at a constant polishing load, respectively, but with a different type of film formed on the substrate and a different type of polishing fluid.

As shown in FIG. 20A, when the polishing load is maintained at a constant value, the polishing rate generally increases as the polishing temperature increases. Therefore, if the temperature of the polishing pad is increased due to the frictional heat generated between the substrate and the polishing pad, the polishing rate is also increased. If the polishing rate is increased too much, it may become difficult to polish the substrate with an accurate film thickness profile. Further, if the polishing rate exceeds a resolution of the polishing-endpoint detection (i.e., an amount of polishing per one rotation of the polishing table), the polishing-endpoint cannot be accurately detected, resulting in a risk of causing excessive polishing.

As shown in FIG. 20B, depending on a type of film to be polished, there is a turning point TP where the polishing rate, which should increase as the polishing temperature increases, begins to decrease. When the polishing temperature exceeds the turning point TP, the polishing rate begins to decrease, so that the CMP apparatus causes the fluid pressures supplied to each pressure chamber to be increased. Then, the surface temperature of the polishing pad may increase more and more, and thus the polishing rate may be more decreased, resulting in a decrease in a throughput of the polishing apparatus.

It is therefore an object of the present invention to provide a polishing method capable of obtaining an accurate film-thickness profile. Further, it is an object of the present invention to provide a polishing apparatus capable of obtaining an accurate film-thickness profile.

Solution to Problem

In one embodiment, there is provided a polishing method, comprising; controlling a temperature of a polishing surface of a polishing pad to a predetermined temperature by use of a pad-temperature regulating apparatus; and polishing a substrate while controlling a polishing load for pressing the substrate against the polishing surface based on measurement values from a film-thickness measuring device which is provided in the polishing pad.

In one embodiment, polishing of the substrate is started immediately after the temperature of the polishing surface reaches the predetermined temperature.

In one embodiment, polishing of the substrate is started after the temperature of the polishing surface has stabilized at the predetermined temperature.

In one embodiment, polishing of the substrate is performed while maintaining the temperature of the polishing surface at the predetermined temperature.

In one embodiment, the predetermined temperature is a first predetermined temperature, polishing of the substrate includes: a first polishing in which the substrate is polished at the first predetermined temperature while controlling the polishing load for pressing the substrate against the polishing surface based on the measurement values of the film-thickness measuring device; and a second polishing in which the substrate is polished at a second predetermined temperature different from the first predetermined temperature while controlling the polishing load for pressing the substrate against the polishing surface based on the measurement values of the film-thickness measuring device, and switching the first polishing to the second polishing is performed when an amount of remaining film in the substrate, measured by the film-thickness measuring device, reaches a predetermined amount.

In one embodiment, the predetermined temperature is a first predetermined temperature, polishing of the substrate includes: a first polishing in which the substrate is polished at the first predetermined temperature while controlling the polishing load for pressing the substrate against the polishing surface based on the measurement values of the film-thickness measuring device; and a second polishing in which the substrate is polished at a second predetermined temperature, which is gradually changed from the first predetermined temperature, while controlling the polishing load for pressing the substrate against the polishing surface based on the measurement values of the film-thickness measuring device, and switching the first polishing to the second polishing is performed when an amount of remaining film in the substrate, measured by the film-thickness measuring device, reaches a predetermined amount.

In one embodiment, there is provided a polishing apparatus, comprising: a polishing table for supporting a polishing pad; a polishing head configured to press a substrate against a surface of the polishing pad so as to polish the substrate; a pad-temperature measuring device configured to measure a temperature of the polishing surface; a pad-temperature regulating apparatus configured to regulate the temperature of the polishing surface; a film-thickness measuring device mounted to the polishing table; and a controller configured to control operations of at least the polishing head and the pad-temperature regulating apparatus, wherein the controller is configured to: control, based on measurement values from the pad-temperature measuring device, the temperature of the polishing surface of the polishing pad to a predetermined temperature by use of the pad-temperature regulating apparatus; and polish the substrate while controlling a polishing load for pressing the substrate against the polishing surface based on the measurement values from the film-thickness measuring device.

In one embodiment, the controller is configured to start polishing of the substrate immediately after the temperature of the polishing surface reaches the predetermined temperature.

In one embodiment, the controller is configured to start polishing of the substrate after the temperature of the polishing surface has stabilized at the predetermined temperature.

In one embodiment, the controller is configured to perform polishing of the substrate while maintaining the temperature of the polishing surface at the predetermined temperature.

In one embodiment, the predetermined temperature is a first predetermined temperature, polishing of the substrate includes: a first polishing in which the substrate is polished at the first predetermined temperature while controlling the polishing load for pressing the substrate against the polishing surface based on the measurement values of the film-thickness measuring device; and a second polishing in which the substrate is polished at a second predetermined temperature different from the first predetermined temperature while controlling the polishing load for pressing the substrate against the polishing surface based on the measurement values of the film-thickness measuring device, and the controller is configured to switch the first polishing to the second polishing when an amount of remaining film in the substrate, measured by the film-thickness measuring device, reaches a predetermined amount.

In one embodiment, the predetermined temperature is a first predetermined temperature, polishing of the substrate includes: a first polishing in which the substrate is polished at the first predetermined temperature while controlling the polishing load for pressing the substrate against the polishing surface based on the measurement values of the film-thickness measuring device; and a second polishing in which the substrate is polished at a second predetermined temperature, which is gradually changed from the first predetermined temperature, while controlling the polishing load for pressing the substrate against the polishing surface based on the measurement values of the film-thickness measuring device, and the controller is configured to switch the first polishing to the second polishing when an amount of remaining film in the substrate, measured by the film-thickness measuring device, reaches a predetermined amount.

Advantageous Effects of Invention

According to the present invention, the temperature of the polishing pad is maintained at a predetermined temperature during polishing of the substrate, thereby enabling the substrate to be polished at a desired polishing rate based on the measurement values of the film-thickness measuring device. As a result, the substrate can be polished with an accurate film-thickness profile.

DESCRIPTION OF EMBODIMENTS

Hereinafter, embodiments according to the present invention will be described with reference to the drawings.

Figure 1:
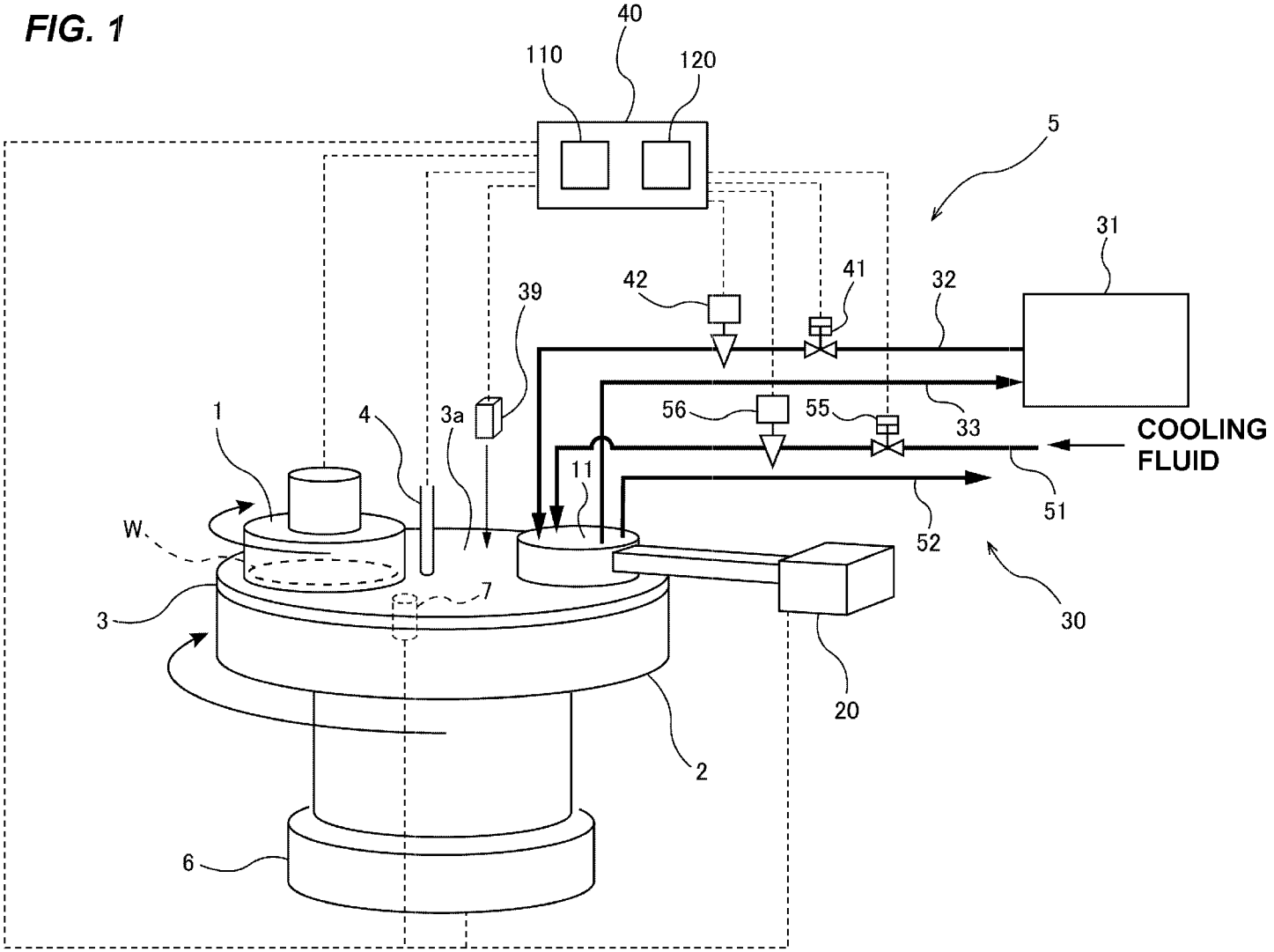
FIG. 1 is a schematic view showing a polishing apparatus according to an embodiment.

FIG. 1 is a schematic view showing a polishing apparatus (CMP apparatus) according to an embodiment. As shown in FIG. 1, the polishing apparatus includes a polishing head 1 for holding and rotating a wafer W which is an example of a substrate, a polishing table 2 that supports a polishing pad 3, a polishing-liquid supply nozzle 4 for supplying a polishing liquid (e.g. a slurry) onto a surface of the polishing pad 3, and a pad-temperature regulating apparatus 5 for regulating a temperature of the surface of the polishing pad 3. The surface (upper surface) of the polishing pad 3 provides a polishing surface 3*a* for polishing the wafer W.

The polishing head 1 is vertically movable, and is rotatable about its axis in a direction indicated by arrow. The wafer W is held on a lower surface of the polishing head 1 by, for example, vacuum suction. A table motor 6 is coupled to the polishing table 2, so that the polishing table 2 can rotate in a direction indicated by arrow. As shown in FIG. 1, the polishing head 1 and the polishing table 2 rotate in the same direction. The polishing pad 3 is attached to an upper surface of the polishing table 2.

The polishing apparatus has a controller 40 for controlling operations of the polishing head 1, the table motor 6, the polishing-fluid supply nozzles 4, and the pad-temperature regulating apparatus 5. The controller 40 is composed of at least one computer. The controller 40 includes, for example, a memory 110 in which programs are stored, and an arithmetic device 120 configured to perform arithmetic operations according to instructions contained in the programs. The arithmetic device 120 includes a CPU (central processing unit) or a GPU (graphic processing unit) configured to perform an arithmetic operation according to instructions contained in the programs. The memory 110 includes a main memory (for example, a random access memory) to which the arithmetic device 120 is accessible, and an auxiliary memory (for example, a hard disk drive or a solid state drive) for storing data and the programs.

The polishing apparatus further includes a film-thickness sensor 7 which serves as a film-thickness measuring device for measuring the film thickness of the wafer W. The film-thickness sensor 7 is fixed to the polishing table 2 and is rotated together with the polishing table 2. The polishing apparatus further includes a film-thickness sensor 7 which serves as a film-thickness measuring device for measuring the film thickness of the wafer W. The film-thickness sensor 7 is fixed to the polishing table 2 and is rotated together with the polishing table 2. The film-thickness sensor 7 is configured to generate a film thickness signal that changes according to the film thickness of the wafer W. The film thickness sensor 7 is arranged in the polishing table 2, and generates film-thickness signals indicating the film thicknesses of a plurality of areas including a central portion of the wafer W each time the polishing table 2 makes one rotation.

Examples of the film-thickness sensor 7 may include an optical sensor and an eddy current sensor. The eddy current sensor is a sensor which detects interlinkage flux generated by an eddy current in the wafer W and detects the thickness of the wafer W based on the interlinkage flux detected. The optical sensor is a sensor which irradiates the wafer W with light, and measures interference waves reflected from the wafer W to detect the thickness of the wafer W.

During polishing of the wafer W, the film-thickness sensor 7 rotates together with the polishing table 2, and generates the film-thickness signal while sweeping across the surface of the wafer W. This film-thickness signal comprises an index value that directly or indirectly indicates the film thickness of the wafer W. The film-thickness signal varies as the film thickness of the wafer W decreases. The film-thickness sensor 7 is coupled to the controller 40, so that the film-thickness signal is sent to the controller 40. When the film thickness of the wafer W, indicated by the film-thickness signal, reaches a predetermined target thickness, the controller 40 instructs the polishing head 1 and the polishing table 2 to terminate polishing of the wafer W.

Figure 2:
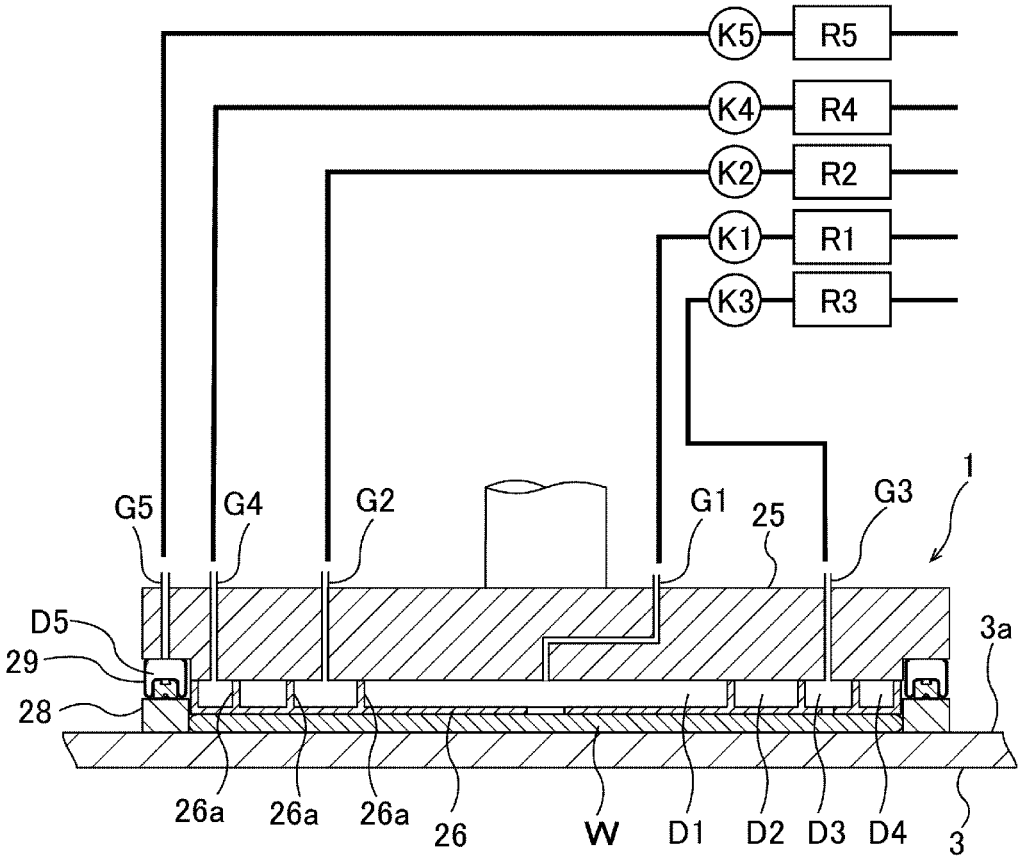
FIG. 2 is a cross-sectional view showing a polishing head shown in FIG. 1.

FIG. 2 is a cross-sectional view showing the polishing head 1 shown in FIG. 1. The polishing head 1 includes a carrier 25 in the form of a circular plate, a circular flexible elastic membrane (membrane) 26 which defines a plurality of (in this embodiment, four) pressure chambers D1, D2, D3, D4 beneath the carrier 25, and a retainer ring 28 which is disposed so as to surround the elastic membrane 26 and press the polishing surface 3*a* of the polishing pad 3. The pressure chambers D1, D2, D3, D4 are formed between the elastic membrane 26 and a lower surface of the carrier 25. The carrier 25 of the polishing head 1 is fixed to a lower end of the head shaft.

The elastic membrane 26 has a plurality of annular partition walls 26*a*, which isolate the pressure chambers D1, D2, D3, D4 from each other. The central pressure chamber D1 is of a circular shape, and the other pressure chambers D2, D3, D4 are annular in shape. The pressure chambers D1, D2, D3, D4 are in concentric arrangement. The number of pressure chambers is not limited particularly, and the polishing head 1 may have more than four or fewer than four pressure chambers.

The pressure chambers D1, D2, D3, D4 are coupled to fluid lines G1, G2, G3, G4, respectively, so that pressurized fluid (e.g., pressurized air) is supplied through the fluid lines G1, G2, G3, G4 into the pressure chambers D1, D2, D3, D4. The fluid lines G1, G2, G3, G4 have pressure regulators R1, R2, R3, R4 mounted therein, respectively. The pressure regulators R1, R2, R3, R4 can regulate the pressure of the pressurized fluid in each of the pressure chambers D1, D2, D3, D4 independently. This operation enables the polishing head 1 to polish the corresponding four areas of the wafer W (i.e., a center area, an inner middle area, an outer middle area, and a peripheral edge area) with the same polishing load or with different polishing loads.

An annular elastic membrane 29 is disposed between the retainer ring 28 and the carrier 25. This elastic membrane 29 has an annular pressure chamber D5 formed therein. The pressure chamber D5 is coupled to a fluid line G5, so that pressurized fluid (e.g., pressurized air) can be supplied through the fluid line G5 into the pressure chamber D5. The fluid line G5 has a pressure regulator R5 mounted therein. The pressure regulator R5 can regulate a pressure of the pressurized fluid in the pressure chamber D5. The pressure in the pressure chamber D5 is applied to the retainer ring 28, which is in turn able to directly press the polishing surface 3*a* of the polishing pad 3 independently of the elastic membrane 26. The fluid lines G1, G2, G3, G4, G5 have flow meters K1, K2, K3, K4, K5 mounted therein, respectively.

During polishing of the wafer W, the elastic membrane 26 presses the wafer W against the polishing surface 3*a* of the polishing pad 3, while the retainer ring 28 presses the polishing surface 3*a* of the polishing pad 3 around the wafer W. The controller 40 controls (or determines) the pressure of pressurized fluid supplied to each of the pressure chambers D1, D2, D3, D4, D5 based on the film-thickness signals sent from the film-thickness sensor 7, which indicate the film thicknesses in the plurality of areas. With this configuration, the pressing force (i.e., polishing load) that presses the wafer W against the polishing pad 3 can be controlled for each area of the wafer W, so that the surface of the wafer W in its entirety can be polished to a uniform film thickness.

In the embodiment shown in FIG. 1, the temperature regulation apparatus 5 includes a heat exchanger 11 configured to regulate the temperature of the polishing surface 3*a* by performing heat exchange with the polishing pad 3, a fluid supply system 30 for supplying a heating fluid having a regulated temperature and a cooling fluid having a regulated temperature into the heat exchanger 11, and an elevating mechanism 20 coupled to the heat exchanger 11. The heat exchanger 11 is located above the polishing table 2 and the polishing surface 3*a* of the polishing pad 3, and has a bottom surface facing the polishing surface 3*a* of the polishing pad 3. The elevating mechanism 20 is configured to raise and lower the heat exchanger 11. More specifically, the elevating mechanism 20 is configured to move the bottom surface of the heat exchanger 11 in a direction toward the polishing surface 3*a* of the polishing pad 3 and in a direction away from the polishing surface 3*a* of the polishing pad 3. The elevating mechanism 20 includes an actuator (not shown), such as a motor or an air cylinder. The operation of the elevating mechanism 20 is controlled by the controller 40.

The fluid supply system 30 includes a heating-fluid supply tank 31 as a heating-fluid supply source for holding the heating fluid having a regulated temperature therein. The fluid supply system 30 further includes a heating-fluid supply pipe 32 and a heating-fluid return pipe 33, each coupling the heating-fluid supply tank 31 to the heat exchanger 11. Ends of the heating-fluid supply pipe 32 and the heating-fluid return pipe 33 are coupled to the heating-fluid supply tank 31, and the other ends are coupled to the heat exchanger 11.

The heating fluid having a regulated temperature is supplied from the heating-fluid supply tank 31 to the heat exchanger 11 through the heating-fluid supply pipe 32, flows in the heat exchanger 11, and is returned from the heat exchanger 11 to the heating-fluid supply tank 31 through the heating-fluid return pipe 33. In this manner, the heating fluid circulates between the heating-fluid supply tank 31 and the heat exchanger 11. The heating-fluid supply tank 31 has a heater (not shown), so that the heating fluid is heated by the heater to have a predetermined temperature.

The fluid supply system 30 includes a first on-off valve 41 and a first flow-rate control valve 42 attached to the heating-fluid supply pipe 32. The first flow-rate control valve 42 is located between the heat exchanger 11 and the first on-off valve 41. The first on-off valve 41 is a valve not having a flow-rate controlling function, whereas the first flow-rate control valve 42 is a valve having a flow-rate controlling function.

The fluid supply system 30 further includes a cooling-fluid supply pipe 51 and a cooling-fluid discharge pipe 52, both coupled to the heat exchanger 11. The cooling-fluid supply pipe 51 is coupled to a cooling-fluid supply source (e.g., a cold water supply source) provided in a factory in which the polishing apparatus is installed. The cooling fluid is supplied to the heat exchanger 11 through the cooling-fluid supply pipe 51, flows in the heat exchanger 11, and is discharged from the heat exchanger 11 through the cooling-fluid discharge pipe 52. In one embodiment, the cooling fluid that has flowed through the heat exchanger 11 may be returned to the cooling-fluid supply source through the cooling-fluid discharge pipe 52.

The fluid supply system 30 further includes a second on-off valve 55 and a second flow-rate control valve 56 attached to the cooling-fluid supply pipe 51. The second flow-rate control valve 56 is located between the heat exchanger 11 and the second on-off valve 55. The second on-off valve 55 is a valve not having a flow-rate controlling function, whereas the second flow-rate control valve 56 is a valve having a flow-rate controlling function.

The first on-off valve 41, the first flow-rate control valve 42, the second on-off valve 55, and the second flow-rate control valve 56 are coupled to the controller 40, so that the operations of the first on-off valve 41, the first flow-rate control valve 42, the second on-off valve 55, and the second flow-rate control valve 56 are controlled by the controller 40.

The polishing apparatus further includes a pad-temperature measuring device 39 for measuring a temperature of the polishing surface 3*a* of the polishing pad 3 (which may hereinafter be referred to as pad surface temperature). The pad-temperature measuring device 39 is coupled to the controller 40. The controller 40 is configured to operate the first flow-rate control valve 42 and the second flow-rate control valve 56 based on the pad surface temperature measured by the pad-temperature measuring device 39. The first on-off valve 41 and the second on-off valve 55 are usually open. The pad-temperature measuring device 39 may be a radiation thermometer configured to measure the temperature of the polishing surface 3*a* of the polishing pad 3 in a non-contact manner. The pad-temperature measuring device 39 is disposed above the polishing surface 3*a* of the polishing pad 3.

The pad temperature measuring device 39 measures the pad surface temperature in a non-contact manner, and sends the measurement value of the pad surface temperature to the controller 40. The pad-temperature measuring device 39 may be an infrared radiation thermometer or thermocouple thermometer which measures the surface temperature of the polishing pad 3, or may be a temperature-distribution measuring device which acquires a temperature distribution (temperature profile) of the polishing pad 3 along a radial direction of the polishing pad 3. Examples of the temperature-distribution measuring device may include a thermography, a thermopile, and an infrared camera. In the case in which the pad-temperature measuring device 39 is the temperature-distribution measuring device, the pad-temperature measuring device 39 is configured to measure a distribution of the surface temperature of the polishing pad 3 in an area including a center and a peripheral portion of the polishing pad 3 and extending in the radial direction of the polishing pad 3. In this specification, the temperature distribution (temperature profile) indicates a relationship between the pad surface temperature and the radial position on the wafer W.

The controller 40 operates the first flow-rate control valve 42 and the second flow-rate control valve 56 based on the measured pad surface temperature to regulate the flow rates of the heating fluid and the cooling fluid such that the pad surface temperature is maintained at a preset target temperature. The first flow-rate control valve 42 and the second flow-rate control valve 56 operate according to control signals from the controller 40, and regulate the flow rate of the heating fluid and the flow rate of the cooling fluid to be supplied to the heat exchanger 11. The heat exchange is performed between the polishing pad 3 and the heating fluid and the cooling fluid flowing in the heat exchanger 11, whereby the pad surface temperature changes.

Such a feedback control allows the temperature of the polishing surface 3*a* of the polishing pad 3 (i.e., the pad surface temperature) to be maintained at the predetermined target temperature. PID control can be used as the feedback control. The target temperature of the polishing pad 3 is determined based on the type of film forming the surface of the wafer W or the polishing process. The determined target temperature is input in advance into the controller 40, and stored in the memory 110.

In order to maintain the pad surface temperature at the predetermined target temperature, the heat exchanger 11 is placed in contact with the surface of the polishing pad 3 (i.e., polishing surface 3*a*) during polishing of the wafer W. In this specification, the manner of contact of the heat exchanger 11 with the polishing surface 3*a* of the polishing pad 3 includes not only direct contact of the heat exchanger 11 with the polishing surface 3*a* of the polishing pad 3, but also contact of the heat exchanger 11 with the polishing surface 3*a* of the polishing pad 3 in the presence of the polishing liquid (or slurry) between the heat exchanger 11 and the polishing surface 3*a* of the polishing pad 3. In any case, heat exchange occurs between the polishing pad 3 and the heating fluid and cooling fluid, flowing in the heat exchanger 11, whereby the pad surface temperature is controlled.

Hot water may be used as the heating fluid to be supplied to the heat exchanger 11. The heating fluid is heated by a heater (not shown) of the heating-fluid supply tank 31 to have a temperature of about, for example, 80° C. In order to increase the surface temperature of the polishing pad 3 more quickly, silicone oil may be used as the heating fluid. When silicone oil is used as the heating fluid, the silicone oil is heated by the heater of the heating-fluid supply tank 31 to have a temperature of 100° C. or more (e.g., about 120° ° C.).

A cooling fluid, such as cold water, or silicone oil, may be used as the cooling fluid supplied to the heat exchanger 11. In the case of using silicone oil as the cooling fluid, a chiller, which serves as the cooling-fluid supply source, may be coupled to the cooling-fluid supply pipe 51 so as to cool the silicone oil to 0° C. or less, so that the heat exchanger 11 can quickly cool the polishing pad 3. Pure water may be used as the cold water. A chiller may be used as the cooling-fluid supply source to cool the pure water to produce the cold water. In this case, the cold water that has flowed through the heat exchanger 11 may be returned to the chiller through the cooling-fluid discharge pipe 52.

The heating-fluid supply pipe 32 and the cooling-fluid supply pipe 51 are completely independent pipes. Therefore, the heating fluid and the cooling fluid are simultaneously supplied to the heat exchanger 11 without being mixed with each other. The heating-fluid return pipe 33 and the cooling-fluid discharge pipe 52 are also completely independent pipes. Accordingly, the heating fluid is returned to the heating fluid supply tank 31 without being mixed with the cooling fluid, and the cooling fluid is drained or is returned to the cooling fluid supply source without being mixed with the heating fluid.

Figure 3:
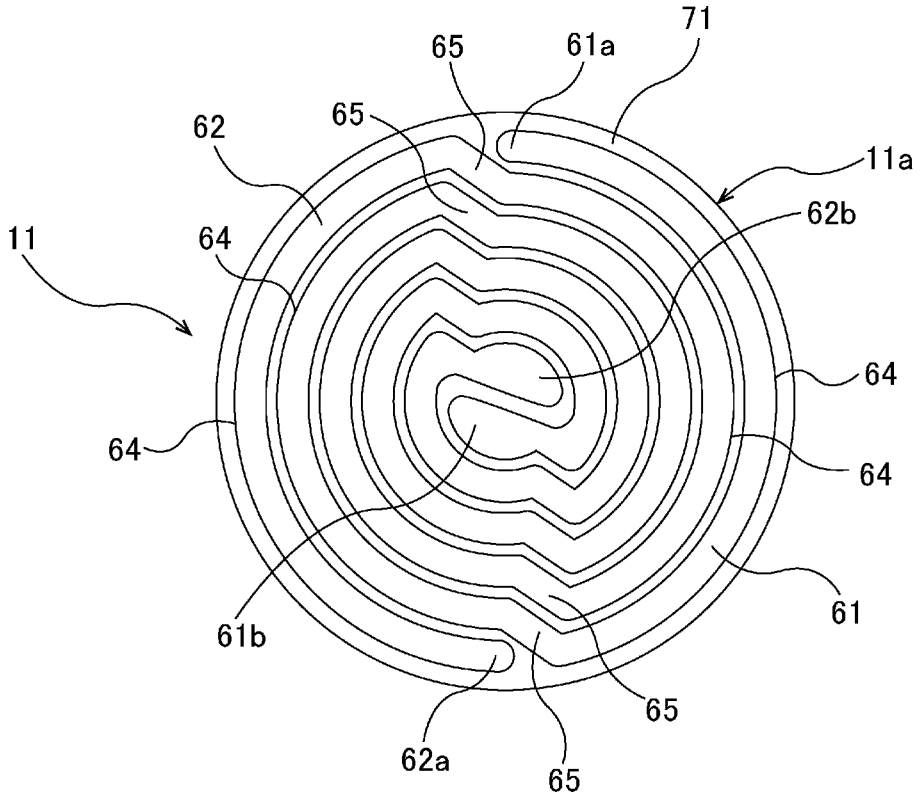
FIG. 3 is a horizontal cross-sectional view showing the heat exchanger according to an embodiment.

Next, the heat exchanger 11 will be described with reference to FIG. 3. FIG. 3 is a horizontal cross-sectional view showing the heat exchanger 11 according to an embodiment. As shown in FIG. 3, the heat exchanger 11 includes a flow-passage structure 71 having a heating flow passage 61 and a cooling flow passage 62 formed therein. In the present embodiment, the entire heat exchanger 11 has a circular shape. A bottom surface of the heat exchanger 11 is flat and circular. The bottom surface of the heat exchanger 11 is constituted by a bottom surface of the flow-passage structure 71. The flow-passage structure 71 is made of a material having excellent wear resistance and high thermal conductivity, which may be ceramic, such as dense SiC.

The heating flow passage 61 and the cooling flow passage 62 are arranged next to each other (or side by side), and extend in a spiral shape. Further, the heating flow passage 61 and the cooling flow passage 62 have a shape of point symmetry, and have the same length. Each of the heating flow passage 61 and the cooling flow passage 62 basically comprises a plurality of arc flow passages 64 having a constant curvature and a plurality of inclined flow passages 65 coupling the arc flow passages 64. Two adjacent arc flow passages 64 are coupled by each inclined flow passage 65.

Such constructions make it possible to locate the outermost portions of the heating flow passage 61 and the cooling flow passage 62 at an outermost portion of the heat exchanger 11. Specifically, the entire bottom surface of the heat exchanger 11 lies under the heating flow passage 61 and the cooling flow passage 62. Therefore, the heating fluid and the cooling fluid can quickly heat and cool the polishing surface 3*a* of the polishing pad 3. The heat exchange between the polishing pad 3 and the heating fluid and cooling fluid is performed in a state such that the slurry is present between the polishing surface 3*a* of the polishing pad 3 and the bottom surface of the heat exchanger 11. It should be noted that the shapes of the heating flow passage 61 and the cooling flow passage 62 are not limited to the embodiment shown in FIG. 2, and the heating flow passage 61 and the cooling flow passage 62 may have other shapes.

The heating-fluid supply pipe 32 (see FIG. 1) is coupled to an inlet 61*a* of the heating flow passage 61, and the heating-fluid return pipe 33 (see FIG. 1) is coupled to an outlet 61*b* of the heating flow passage 61. The cooling-fluid supply pipe 51 (see FIG. 1) is coupled to an inlet 62*a* of the cooling flow passage 62, and the cooling-fluid discharge pipe 52 (see FIG. 1) is coupled to an outlet 62*b* of the cooling flow passage 62. The inlets 61*a* and 62*a* of the heating flow passage 61 and the cooling flow passage 62 are located at the peripheral portion of the heat exchanger 11, and the outlets 61*b* and 62*b* of the heating flow passage 61 and the cooling flow passage 62 are located at the central portion of the heat exchanger 11. Therefore, the heating fluid and the cooling fluid flow spirally from the peripheral portion toward the central portion of the heat exchanger 11. The heating flow passage 61 and the cooling flow passage 62 are completely separated, so that the heating fluid and the cooling fluid are not mixed in the heat exchanger 11.

Figure 4:
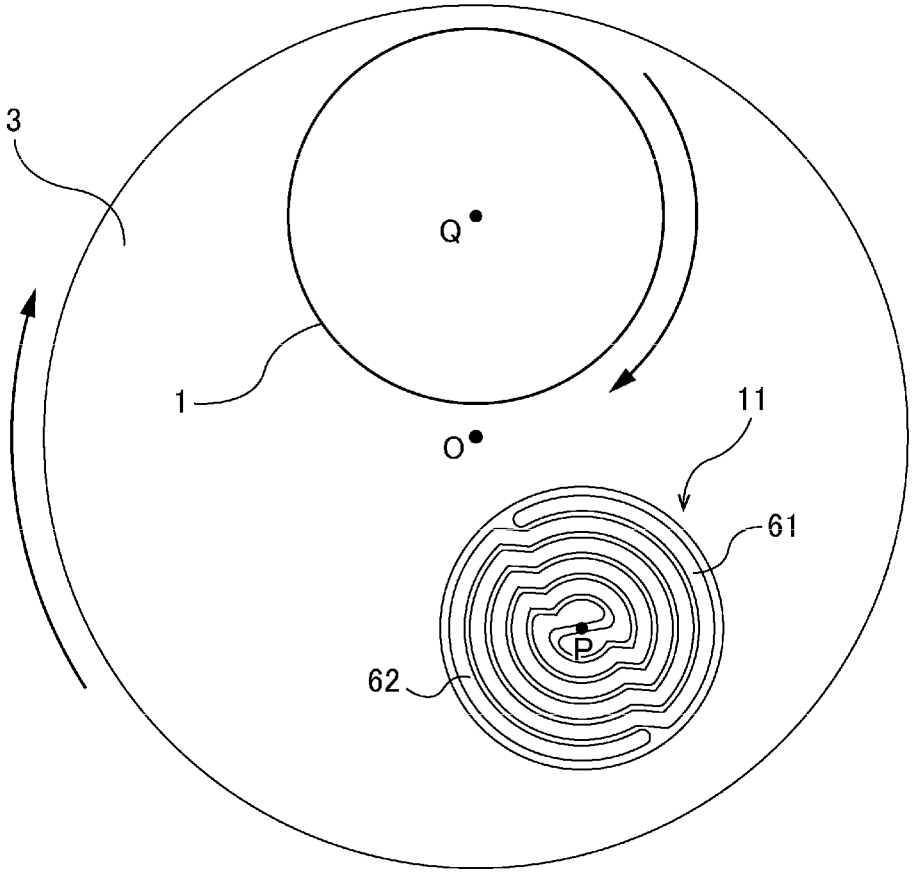
FIG. 4 is a plan view showing a positional relationship between the heat exchanger and the polishing head on the polishing pad.

FIG. 4 is a plan view showing a positional relationship between the heat exchanger 11 and the polishing head 1 on the polishing pad 3. The heat exchanger 11 has a circular shape when viewed from above, and has a diameter smaller than the diameter of the polishing head 1. A distance from a rotating center O of the polishing pad 3 to a center P of the heat exchanger 11 is equal to a distance from the rotating center O of the polishing pad 3 to a center Q of the polishing head 1. Since the heating flow passage 61 and the cooling flow passage 62 are adjacent to each other, the heating flow passage 61 and the cooling flow passage 62 are arranged not only along the radial direction of the polishing pad 3, but also along the circumferential direction of the polishing pad 3. Therefore, while the polishing table 2 and the polishing pad 3 are rotating, the polishing pad 3 performs the heat exchange with both of the heating fluid and the cooling fluid.

In the polishing apparatus having such pad-temperature regulating apparatus 5, polishing of wafers W is performed in the following manner. The wafer W, to be polished, is held by the polishing head 1, and is then rotated by the polishing head 1. The polishing table 2 is rotated together with the polishing pad 3 by use of the table motor 6. In this state, the polishing liquid (slurry) is supplied from the polishing-liquid supply nozzle 4 onto the polishing surface 3*a* of the polishing pad 3. Next, the heat exchanger 11 of the pad-temperature regulating apparatus 5 is brought into contact with the polishing surface 3*a* of the polishing pad 3, thereby regulating and maintaining the temperature of the polishing surface 3*a* at a predetermined temperature. Further, the surface of the wafer W is pressed by the polishing head 1 against the polishing surface 3*a* of the polishing pad 3. The surface of the wafer W is polished by the sliding contact with the polishing pad 3 in the presence of the slurry. The surface of the wafer W is planarized by the chemical action of the slurry and the mechanical action of abrasive grains contained in the slurry.

Figure 5A:
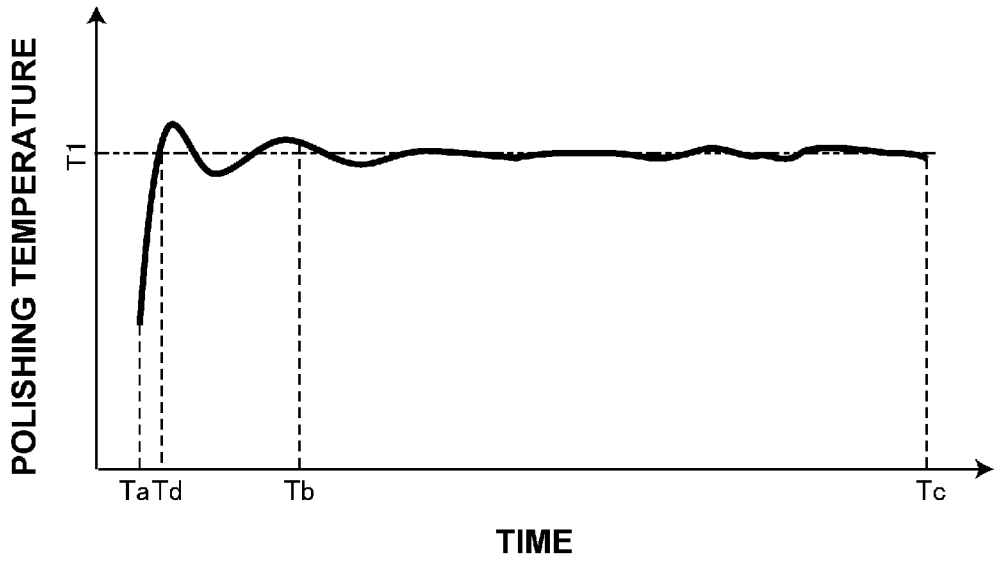
FIG. 5A is a graph illustrating an example of the change in temperature of the polishing surface of the polishing pad, which is regulated by the pad-temperature regulating apparatus during polishing of the wafer.
Figure 5B:
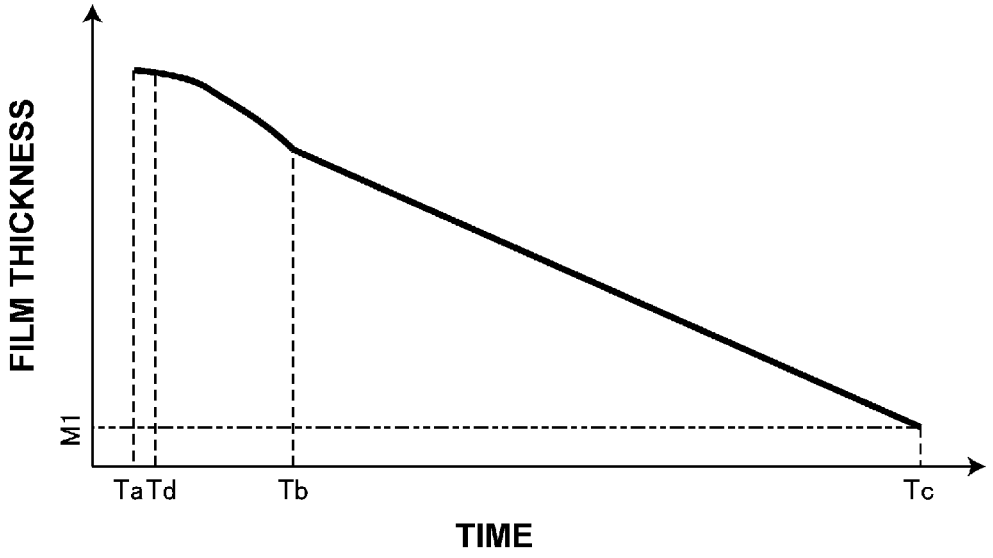
FIG. 5B is a graph illustrating the change in film thickness of the wafer.

FIG. 5A is a graph illustrating an example of the change in temperature of the polishing surface 3*a* of the polishing pad 3, which is regulated by the pad-temperature regulating apparatus 5 during polishing of the wafer W. FIG. 5B is a graph illustrating the change in film thickness of the wafer W. In FIG. 5A, a vertical axis represents the temperature of the polishing surface 3*a*, and a horizontal axis represents the elapsed time. In FIG. 5B, a vertical axis represents the film thickness of the wafer W, and a horizontal axis represents the elapsed time.

In this embodiment, as shown in FIG. 5A, the heat exchanger 11 is brought into contact with the polishing surface 3*a* of the polishing pad 3 at time point Ta, and the polishing surface 3*a* is heated so that the temperature of the polishing surface 3*a* reaches the predetermined temperature T1. The time point Ta corresponds to a time point when temperature regulation of the polishing surface 3*a* using the pad-temperature regulating apparatus 5 is started. In this embodiment, the wafer W held by the polishing head 1 is pressed against the polishing surface 3*a* at the time point Ta. At this time, the pressures of the pressurized fluid supplied to the pressure chambers D1, D2, D3, D4, D5 (see FIG. 2) are of being set to any desired values, respectively. Accordingly, polishing of the wafer W, in which the polishing load for pressing the wafer W against the polishing surface 3*a* is controlled based on the measurement values of the film-thickness sensor (film-thickness measuring device) 7, has not been started.

Next, the controller 40 determines, based on the measurement values of temperature of the polishing surface 3*a* sent from the pad-temperature measuring device 39, whether or not the temperature of the polishing surface 3*a* has stabilized at the predetermined temperature T1. For example, the controller 40 stores in advance allowable values set with respect to the predetermined temperature T1, and monitors whether or not the temperature of the polishing surface 3*a* stays within these allowable values for a predetermined elapsed time. The controller 40 determines a point in time when elapsed time during which the temperature of the polishing surface 3*a* is within the allowable values has reached a predetermined elapsed time, as a stability time point Tb.

In one embodiment, the controller 40 may press the wafer W held by the polishing head 1 against the polishing surface 3*a* of the polishing pad 3 at the time point Tb instead of the time point Ta.

Next, when the polishing time reaches the stability time point Tb, the controller 40 starts polishing of the wafer W in which the polishing load for pressing the wafer W against the polishing surface 3*a* is controlled based on the measurement values from the film-thickness sensor (film-thickness measuring device) 7. Even if frictional heat is generated between the wafer W and the polishing pad 3, the temperature of the polishing surface 3*a* of the polishing pad 3 is maintained at the predetermined temperature T1 by the pad-temperature regulating apparatus 5 after the time point Tb. Therefore, since the polishing rate does not change depending on the polishing temperature, the wafer W can be polished at the desired polishing rate based on the measurement values from the film-thickness sensor 7. This means that, as shown in FIG. 5B, the film thickness decreases at a constant rate. As a result, the substrate can be polished with an accurate film thickness profile. When the wafer W is polished until the film thickness reaches a target film thickness M1, the controller 40 terminates polishing of the wafer W at that time Tc.

Figure 20A:
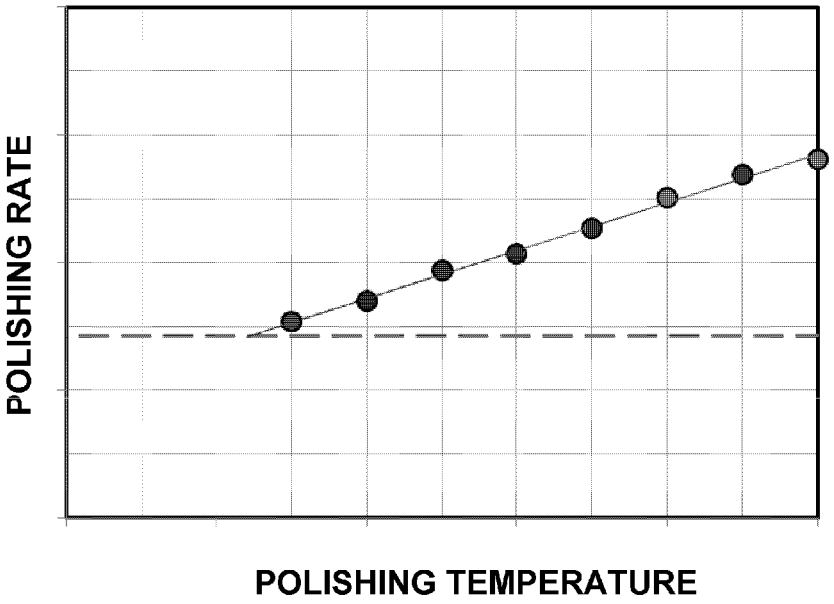
FIG. 20A is a view showing an example of relationship between a polishing rate and a polishing temperature during polishing of a substrate at a predetermined polishing load.
Figure 20B:
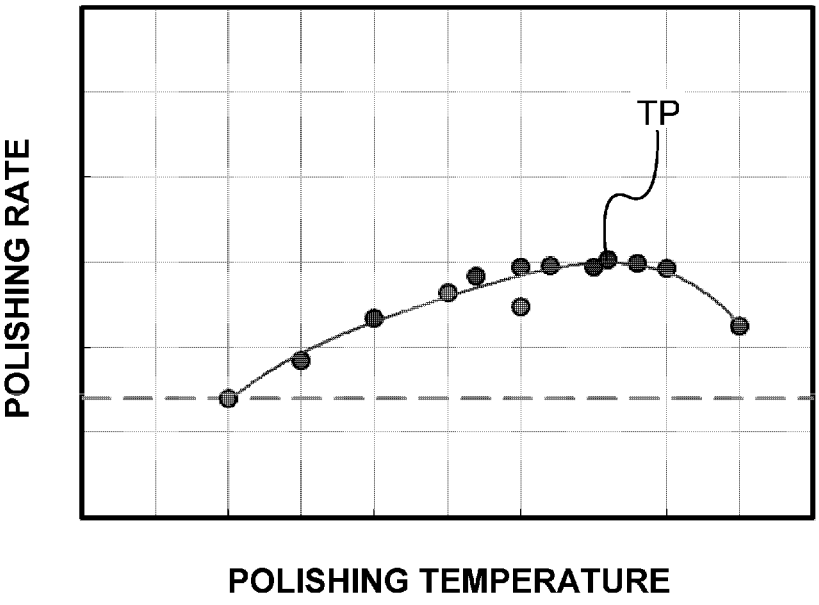
FIG. 20B is a view showing another example of relationship between a polishing rate and a polishing temperature during polishing of a substrate at a predetermined polishing load.

According to this embodiment, even if the film to be polished is the film having the turning point TP shown in FIG. 20B, the polishing rate does not change during polishing of the wafer W, resulting in no decrease in the throughput of the polishing apparatus. On the contrary, setting the predetermined temperature T1 to the polishing temperature at or near the turning point TP makes it possible to polish the wafer W at the maximum polishing rate. As a result, the throughput of the polishing apparatus can be increased.

In one embodiment, if the time point Tb does not appear even after a predetermined time TE has elapsed from the time point Ta, the controller 40 may start polishing of the wafer W in which the polishing load for pressing the wafer W against the polishing surface 3*a* is controlled based on the measurement values from the film-thickness sensor 7. In this case, an abnormality may be occurring in the components of the polishing apparatus including the pad-temperature regulating apparatus 5 and the pad-temperature measuring device 39 and/or the wafer W, and therefore the controller 40 may issue an alarm, or may stop polishing of the wafer W in addition to the alarm. The controller 40 stores in advance the predetermined time TE.

In one embodiment, if the time point Tb is not reached after polishing a predetermined amount of film, the controller 40 may start polishing the wafer W in which the polishing load for pressing the wafer W against the polishing surface 3*a* is controlled based on the measurement values from the film-thickness sensor 7. In this case also, an abnormality may be occurring in the components of the polishing apparatus including the pad-temperature regulating apparatus 5 and the pad-temperature measuring device 39 and/or the wafer W, and therefore the controller 40 may issue an alarm, or may stop polishing of the wafer W in addition to the alarm. The controller 40 stores in advance the above-mentioned predetermined amount.

In the case where the film-thickness sensor 7 is of the eddy current sensor, the measurement values may be affected by the ambient temperature, depending on the type of the eddy current sensor. Therefore, in this embodiment, the controller 40 may correct the measurement values of the eddy current sensors. For example, a relational equation or a table representing a relationship between temperature and the measurement value of the eddy current sensor is obtained in advance through experiments, and this relational equation or table is used to correct the measurement value of the eddy current sensor.

In one embodiment, the controller 40 may start polishing of the wafer W, in which the polishing load for pressing the wafer W against the polishing surface 3*a* is controlled (or regulated) based on the measurement values from the film-thickness sensor 7, immediately after a time point Td at which the temperature of the polishing surface 3*a* of the polishing pad 3 first reaches the predetermined temperature T1. In this case, the polishing rate is not stable between the time point Td and the time point Tb. However, after the time point Tb, the polishing rate becomes stable, and therefore the substrate can be polished with an accurate film thickness profile eventually. In one embodiment, the wafer W held by the polishing head 1 may be pressed against the polishing pad 3*a* of the polishing pad 3 at the time point Td, instead of the time point Ta.

As described above, the polishing rate of the wafer W depends also on the temperature of the polishing surface 3*a* of the polishing pad 3. Therefore, in order to obtain a more accurate film thickness profile while preventing the decrease in throughput, the above predetermined temperature T1 may be changed. In the description of the following embodiments described with reference to FIGS. 6A and 6B, and in the description of the following embodiments described with reference to FIGS. 8A and 8B, the aforementioned predetermined temperature T1 is referred to as a "first predetermined temperature T1", and the polishing temperature of the polishing surface 3*a* changed from the first predetermined temperature is referred to as a "second predetermined temperature T2". Configurations of these embodiments, which are not specifically described, are the same as the configuration of the embodiments described with reference to FIGS. 5A and 5B, and thus duplicate descriptions thereof are omitted.

Figure 6A:
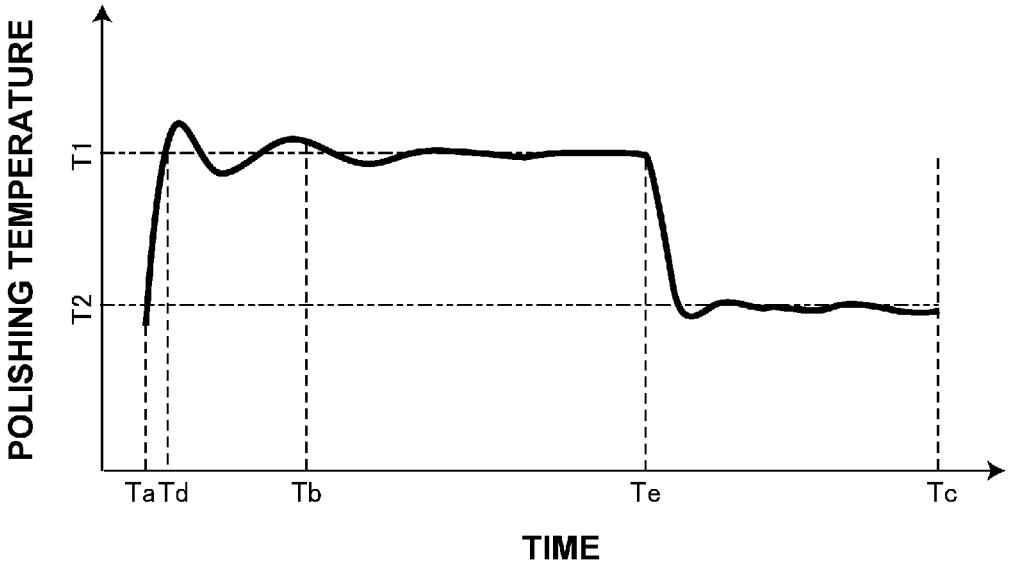
FIG. 6A is a graph illustrating another example of the change in temperature of the polishing surface of the polishing pad, which is regulated by the pad-temperature regulating apparatus during polishing of the wafer.
Figure 6B:
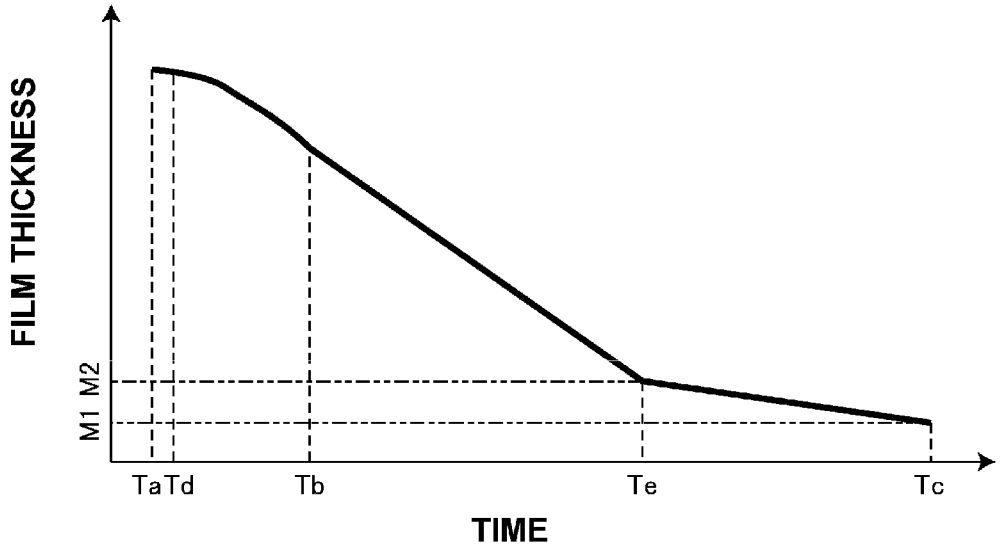
FIG. 6B is a graph illustrating the change in film thickness of the wafer.

FIG. 6A is a graph illustrating another example of the change in temperature of the polishing surface 3*a* of the polishing pad 3, which is regulated by the pad-temperature regulating apparatus 5 during polishing of the wafer W, and FIG. 6B is a graph illustrating the change in film thickness of the wafer W. In FIG. 6A, a vertical axis represents the temperature of the polishing surface 3*a*, and a horizontal axis represents the elapsed time. In FIG. 6B, a vertical axis represents the film thickness of wafer W, and a horizontal axis represents the elapsed time.

As shown in FIGS. 6A and 6B, the controller 40 changes the first predetermined temperature T1 to the second predetermined temperature T2 when the film thickness of the wafer W reaches the temperature switching film thickness M2. In this embodiment, the second predetermined temperature T2 is lower than the first predetermined temperature T1, and the polishing rate at the second predetermined temperature T2 is lower than the polishing rate at the first predetermined temperature.

Figure 7:
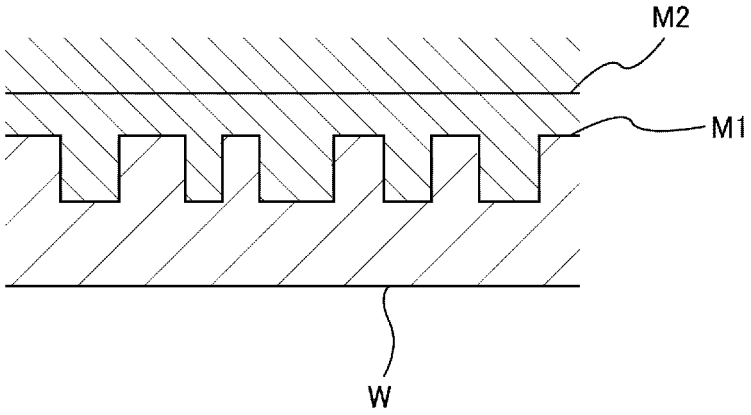
FIG. 7 is a schematic view for illustrating a temperature-switching film thickness.

FIG. 7 is a schematic view for illustrating the temperature-switching film thickness M2. In FIG. 7, a cross-section of the wafer W, which is the object to be polished, is schematically illustrated. As shown in FIG. 7, the temperature switching film thickness M2 is set near the target film thickness M1.

In this embodiment, the controller 40 causes the wafer W to be polished while controlling and maintaining the temperature of the polishing surface 3*a* at the first predetermined temperature T1, which becomes a higher polishing rate (e.g., the maximum polishing rate), until the film thickness reaches the temperature switching film thickness M2. When the film thickness reaches the temperature switching film thickness M2, the controller 40 changes the temperature of the polishing surface 3*a* to the second predetermined temperature T2 where the polishing rate is lower than the polishing rate at the first predetermined temperature T1. At the second predetermined temperature T2, polishing of the wafer W is progressed slowly, thereby enabling a more accurate film thickness profile to be obtained. On the other hand, the temperature of the polishing surface 3*a* is maintained at the first predetermined temperature T1, which becomes a high polishing rate, until the film thickness reaches the temperature switching thickness M2, resulting in preventing a decrease in throughput.

In the embodiment shown in FIGS. 6A and 6B, the second predetermined temperature T2 is lower than the first predetermined temperature T1. However, depending on the type of film in the wafer W, properties of the slurry, and/or polishing conditions (e.g., a rotational speed of the polishing head 1 and a rotational speed of the polishing table 2), increasing the temperature of the polishing surface 3*a* may result in a lower polishing rate. For example, if the film to be polished is the film having the turning point TP shown in FIG. 20B, the polishing rate can be reduced by increasing the temperature of the polishing surface 3*a* higher than the polishing temperature of the turning point TP. In such a case, the second predetermined temperature T2 may be set higher than the first predetermined temperature T1.

In this embodiment, the second predetermined temperature T2 and the temperature switching film thickness M2 are preferably set in consideration of the type of film to be polished, polishing conditions (e.g., the rotational speeds of the polishing head 1 and the polishing table 2, and the type of slurry), and throughput of the polishing apparatus. For example, if a suppression of throughput reduction in the polishing apparatus is intended, the temperature switching film thickness M2 may be set as close as possible to the target film thickness M1, or the second predetermined temperature T2 may be set as high (or low) as possible, while taking into consideration the type of film to be polished and the polishing conditions.

Figure 8A:
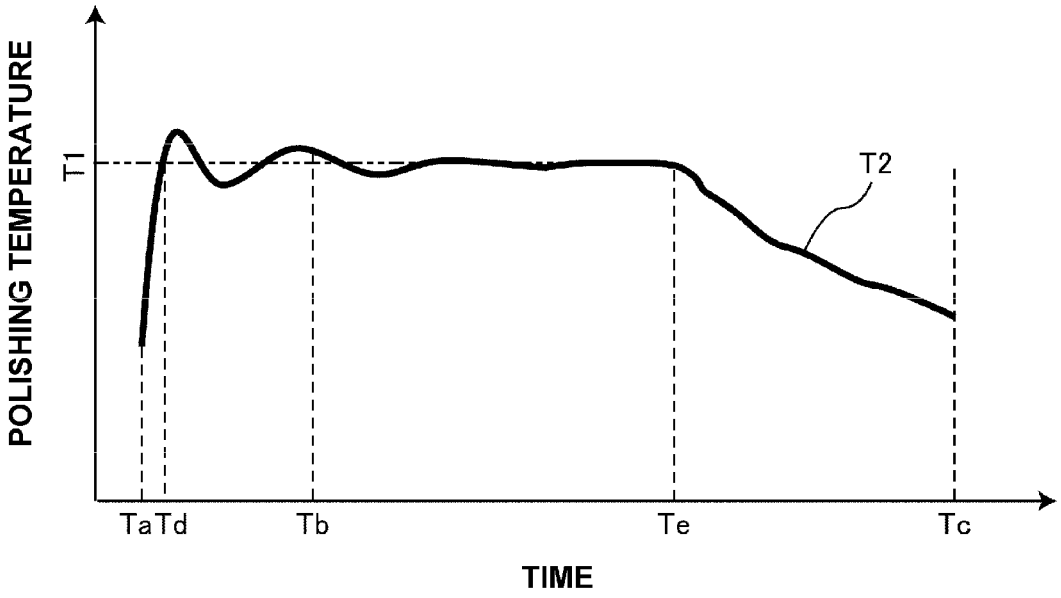
FIG. 8A is a graph illustrating still another example of the change in temperature of the polishing surface of the polishing pad, which is regulated by the pad-temperature regulating apparatus during polishing of the wafer.
Figure 8B:
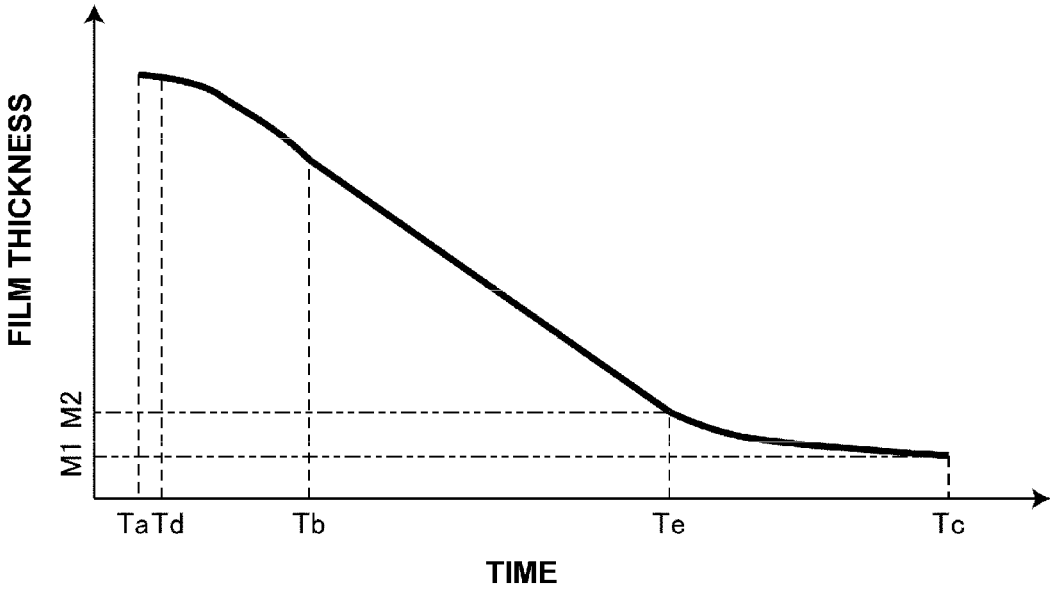
FIG. 8B is a graph illustrating the change in film thickness of the wafer.

FIG. 8A is a graph illustrating still another example of the change in temperature of the polishing surface 3*a* of the polishing pad 3, which is regulated by the pad-temperature regulating apparatus 5 during polishing of the wafer W. FIG. 8B is a graph illustrating the change in film thickness of the wafer W. In FIG. 8A, a vertical axis represents the temperature of the polishing surface 3*a*, and a horizontal axis represents the elapsed time. In FIG. 8B, a vertical axis represents the film thickness of the wafer W, and a horizontal axis represents the elapsed time.

In the embodiment shown in FIGS. 8A and 8B also, when the film thickness reaches the temperature switching film thickness M2, the controller 40 changes the temperature of the polishing surface 3*a* from the first predetermined temperature T1 to the second predetermined temperature T2, where the polishing rate is lower than the polishing rate at the first predetermined temperature. In this embodiment, the controller 40 causes the second predetermined temperature T2 to be gradually decreased. This control enables the polishing rate to be gradually decreased, so that a more accurate film thickness profile can be obtained while suppressing the reduction in throughput. Similar to the embodiment described with reference to FIGS. 6A and 6B, the controller 40 may cause the second predetermined temperature T2 to be gradually increased when increasing the temperature of the polishing surface 3*a* results in a decrease in the polishing rate.

In this embodiment also, similar to the embodiment described with reference to FIGS. 5A and 5B, the second predetermined temperature T2 and the temperature switching film thickness M2 are preferably set in consideration of the type of film to be polished, the polishing conditions (e.g., the rotational speeds of the polishing head 1 and the polishing table 2, and the type of slurry), and throughput of the polishing apparatus. Further, in this embodiment, controlling of an amount of change in the second predetermined temperature makes it possible to control the throughput of the polishing apparatus. For example, if the amount of change in the second predetermined temperature is set higher, the throughput of the polishing apparatus can be improved. In contrast, if the amount of change in the second predetermined temperature is set lower, a more accurate film thickness profile can be obtained.

In the embodiments described above, the pad-temperature regulating apparatus 5 has the heat exchanger 11, which comes into contact with the polishing surface 3*a*, as a device for regulating the temperature of the polishing surface 3*a* of the polishing pad 3 (i.e., a device that functions as a heating device and a cooling device for the polishing surface 3*a*). In other words, the pad-temperature regulating apparatus 5 described above is a contact-type pad-temperature regulating apparatus in which the heat exchanger 11 comes into contact with the polishing surface 3*a*. However, the pad-temperature regulating apparatus 5 may be a non-contact type pad-temperature regulating apparatus that has no component coming into contact with the polishing surface 3*a*.

Figure 9:
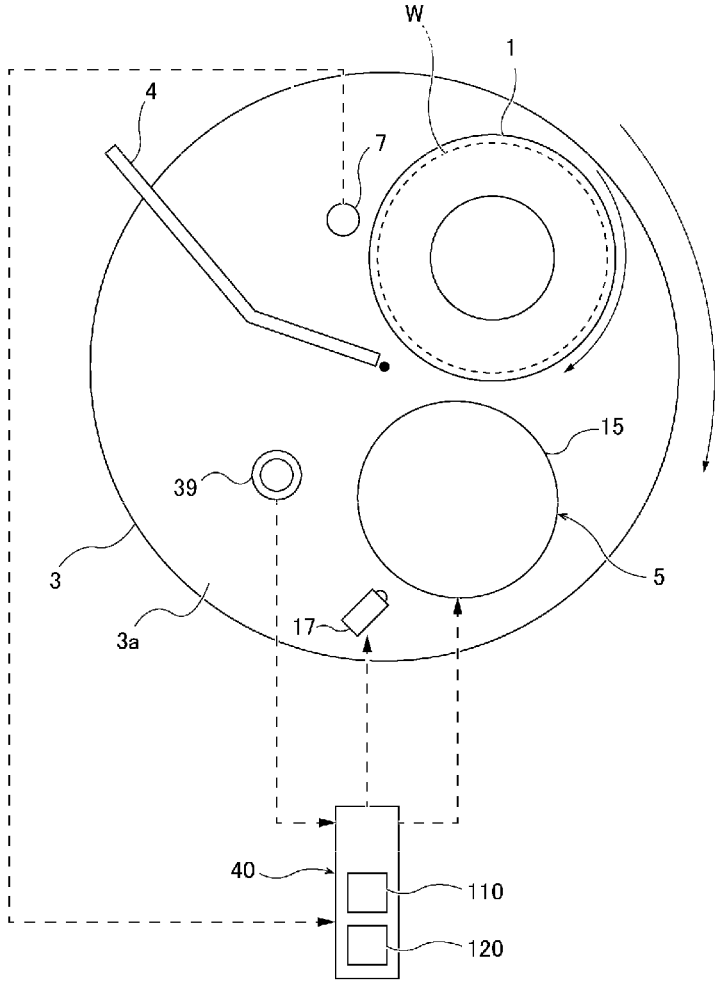
FIG. 9 is a schematic plan view showing a polishing apparatus according to another embodiment.

FIG. 9 is a schematic plan view showing a polishing apparatus (CMP apparatus) according to another embodiment. The polishing apparatus shown in FIG. 9 differs from the polishing apparatus shown in FIG. 1 only in configuration of the pad-temperature regulating apparatus. Therefore, Identical or corresponding structural elements are denoted by identical reference numerals, and thus duplicate descriptions thereof are omitted.

In this embodiment, the pad-temperature regulating apparatus 5 is a non-contact type of pad-temperature regulating device arranged above the polishing surface 3*a* of the polishing pad 3. This pad-temperature regulating apparatus 5 includes a heating device (infrared heater) 15 extending parallel to the polishing surface 3*a* of the polishing pad 3.

The infrared heater 15 radiates infrared rays (radiant heat) to the polishing surface 3*a* of the polishing pad 3. In this embodiment, the infrared heater 15 has a disk shape arranged in parallel to the polishing pad 3 (i.e., in the horizontal direction), but the shape of the infrared heater 15 is not limited to this embodiment. In one embodiment, the infrared heater 15 may have a rectangular shape extending in the radial direction of the polishing pad 3. In one embodiment, the infrared heater 15 may be configured to swing along the radial direction of the polishing pad 3.

Figure 10:
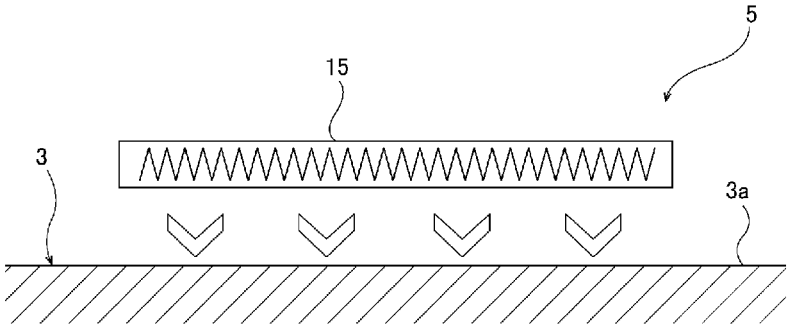
FIG. 10 is a schematic view showing an infrared heater shown in FIG. 9.

FIG. 10 is a schematic view showing the infrared heater 15 shown in FIG. 9. As shown in FIG. 10, the infrared heater 15 is arranged above the polishing pad 3. More specifically, the infrared heater 15 is arranged at a height that does not adhere to the polishing liquid supplied onto the polishing surface 3*a* of the polishing pad 3, and that can heat the polishing surface 3*a*. With this arrangement, any component of the pad-temperature regulating apparatus 5 is not in contact with the polishing pad 3. Therefore, contamination of the wafer W caused by contact between the components of the pad-temperature regulating apparatus 5 and the polishing surface 3*a* of the polishing pad 3 can be prevented.

Further, if any component of the pad-temperature regulating apparatus 5 comes into contact with the polishing pad 3 (polishing surface 3*a*), polishing liquid inevitably adheres (or fixes) to this component. In this case, the adhered polishing liquid may fall down to the polishing surface 3*a* of the polishing pad 3 as a foreign matter, and as a result, defects, such as scratches, may be generated on the wafer W. According to configuration of this embodiment, since none of the components in the pad-temperature regulating apparatus 5 comes into contact with the polishing pad 3, defects such as scratches are not generated on the wafer W by foreign matter that falls down from the components of the pad-temperature regulating apparatus 5.

As shown in FIG. 9, the pad-temperature regulating apparatus 5 may include a cooling device 17 for cooling the polishing surface 3*a* of the polishing pad 3. An example of the cooling device 17 may include a cooling device that jets gas onto the polishing surface 3*a* to cool the polishing surface 3*a*. As shown in FIG. 9, the cooling device 17 is coupled to the controller 11, and the controller 11 can control the cooling device 17 independently of the infrared heater 15. With such a configuration, the controller 11 can more accurately regulate the temperature of the polishing surface 3*a*.

Figure 11:
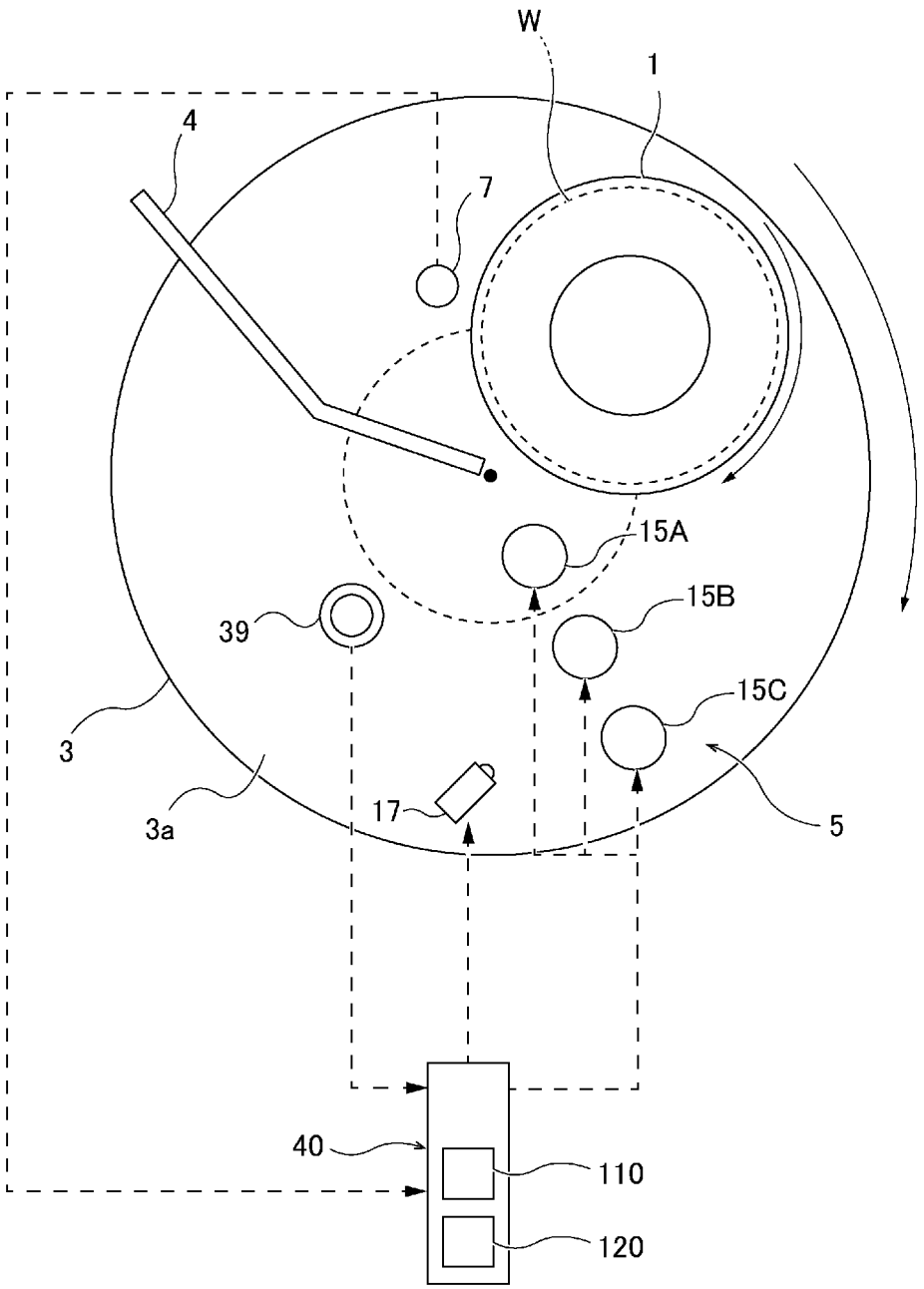
FIG. 11 is a view showing a plurality of infrared heaters arranged in the radial direction of the polishing pad.

In one embodiment, the pad-temperature regulating apparatus 5 may have a plurality of heating devices. FIG. 11 is a view showing a plurality of infrared heaters 15A, 15B, 15C arranged in the radial direction of the polishing pad 3. The pad-temperature regulating apparatus 5 shown in FIG. 11 includes a plurality (three in this embodiment) of infrared heaters 15A, 15B, 15C arranged in series in the radial direction of the polishing pad 3. The number of infrared heaters is not limited to this embodiment. Two infrared heaters may be provided, or four or more infrared heaters may be provided.

Each of the plurality of infrared heaters 15A, 15B, 15C is coupled to the controller 11. The controller 11 can individually control each of the infrared heaters 15A, 15B and 15C, and can partially change the surface temperature of the polishing pad 3. In one embodiment, each infrared heater 15A, 15B and 15C may be configured to be swingable along the radial direction of the polishing pad 3.

Figure 12:
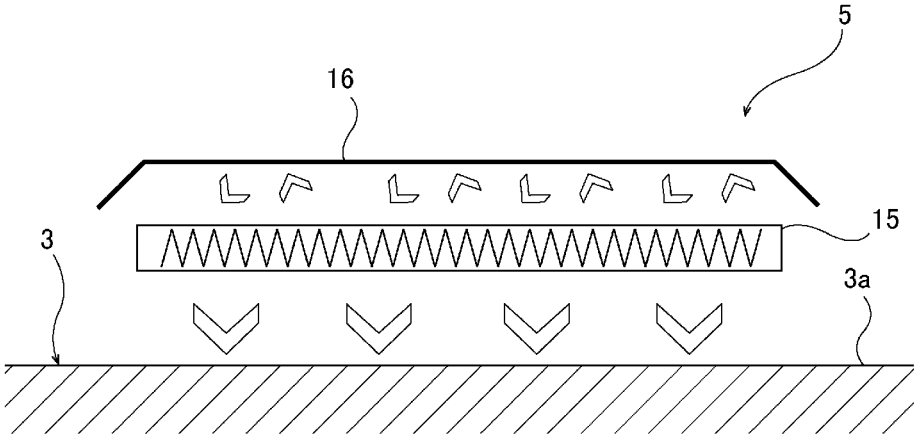
FIG. 12 is a view showing the pad-temperature regulating apparatus including a reflecting plate.

FIG. 12 is a view showing the pad-temperature regulating apparatus including a reflecting plate. As shown in FIG. 12, the pad-temperature regulating apparatus 5 may include the reflecting plate 16 for reflecting infrared rays emitted from the infrared heater 15 toward the polishing pad 3. The reflecting plate 16 is arranged above the infrared heater 15 so as to cover the infrared heater 15. The reflecting plate 16 can efficiently reflect the infrared rays emitted from the infrared heater 15 to the polishing surface 3*a* of the polishing pad 3 by use of a reflection function thereof. In one embodiment, the reflecting plates 16 may be arranged not only above the infrared heater 15 but also laterally to the infrared heater 15.

Figure 13:
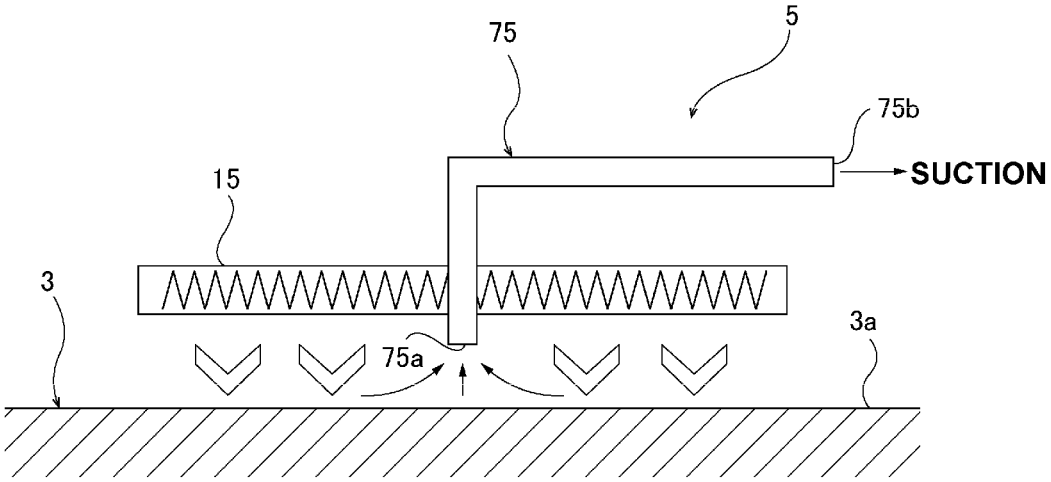
FIG. 13 is a view showing the pad-temperature regulating device including a suction nozzle.
Figure 14:
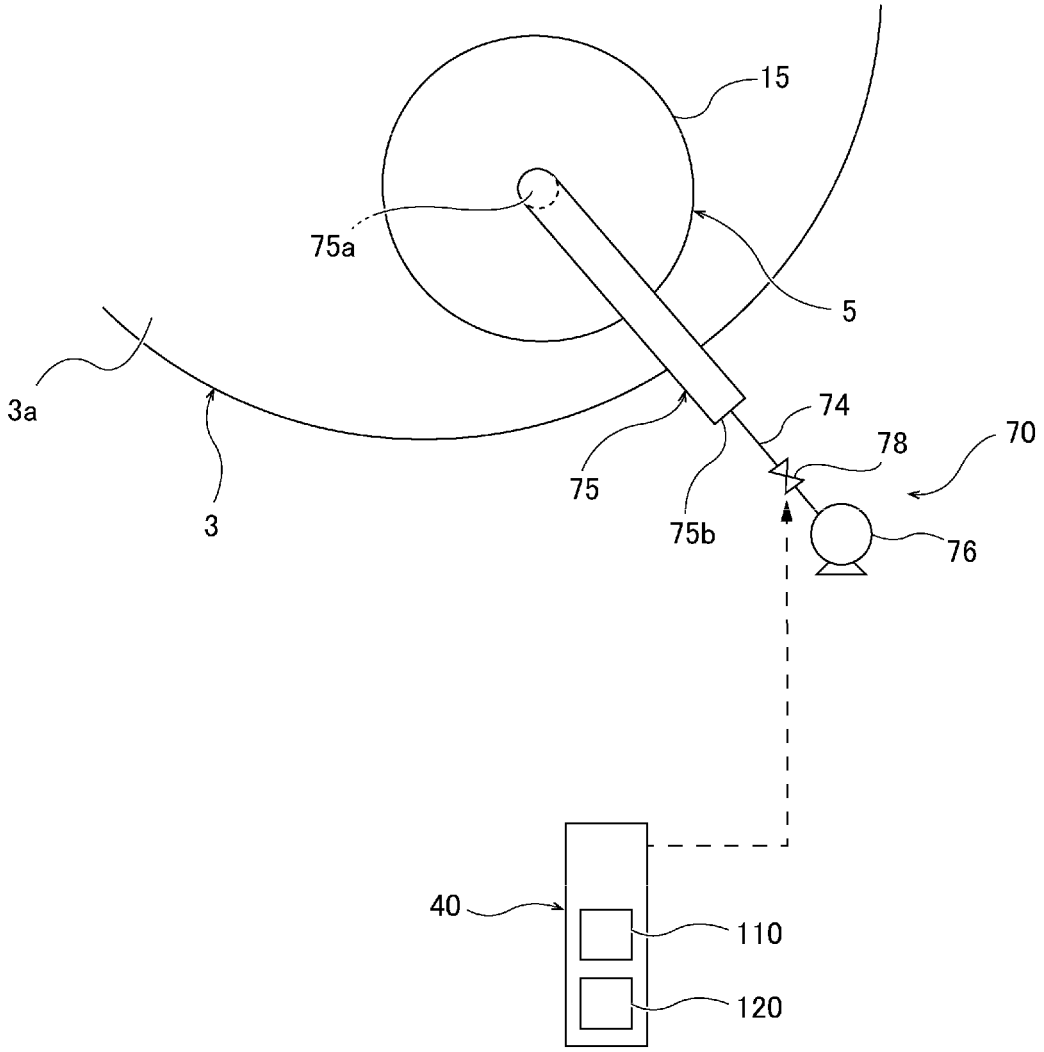
FIG. 14 is a view showing the pad-temperature regulating device including a suction nozzle.

FIGS. 13 and 14 are views each showing the pad-temperature regulating device including a suction nozzle. As shown in FIGS. 13 and 14, the pad-temperature regulating apparatus 5 may include the suction nozzle 75 for decreasing an ambient temperature by sucking hot air near the polishing surface 3*a* of the polishing pad 3 heated by the infrared heater 15. The suction nozzle 75 is configured to suck air above the polishing surface 3*a*, which is adjacent to the polishing surface 3*a*, to thereby decrease the temperature of the polishing surface 3*a*.

The suction nozzle 75 is coupled to a suction device 76. More specifically, a suction port 75*a* of the suction nozzle 75 is disposed above the polishing surface 3*a*, and a coupling end 75*b* of the suction nozzle 75 is coupled to the suction device 76 through a suction line 74. A control valve 78 is disposed in the suction line 74. The suction nozzle 75, the suction line 74, the control valve 78, and the suction device 76 constitute a suction mechanism 70. The pad-temperature regulating apparatus 5 includes the suction mechanism 70.

The suction port 75*a* of the suction nozzle 75 is arranged at a height that does not suck the polishing liquid supplied onto the polishing surface 3*a* of the polishing pad 3, and that can suck heat of the polishing surface 3*a*. In the embodiment shown in FIG. 13, the suction port 75*a* of the suction nozzle 75 is located at a center of the infrared heater 15. However, the location of the suction port 75*a* is not limited to the embodiment shown in FIG. 13.

Figure 15:
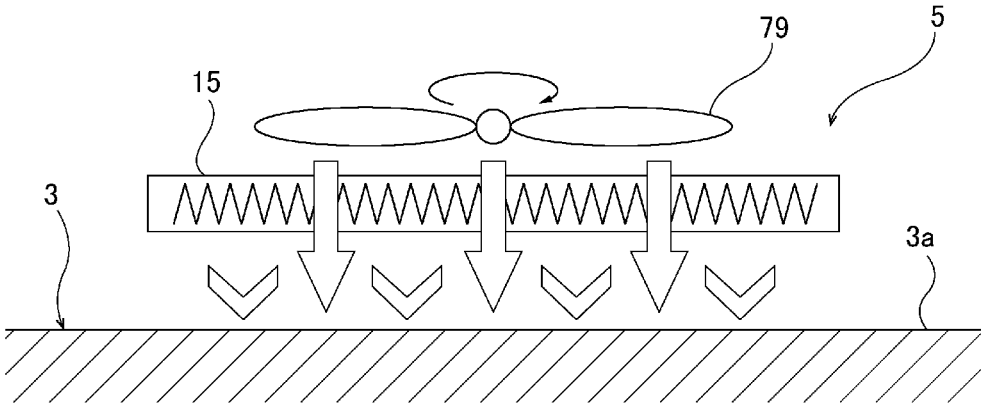
FIG. 15 is a view showing the pad-temperature regulating apparatus according to still another embodiment.

FIG. 15 is a view showing the pad-temperature regulating apparatus according to still another embodiment. Configuration and operation of this embodiment, which is not described particularly, are the same as those of the embodiments described above, and thus duplicate descriptions thereof are omitted. As shown in FIG. 15, the pad-temperature regulating apparatus 5 may include a fan 79 that is arranged adjacent to the infrared heater 15, and is configured to form a flow of air (see arrows in FIG. 15) toward the polishing surface 3*a* of the polishing pad 3.

In the embodiment shown in FIG. 15, the fan 79 is disposed above the infrared heater 15, and is arranged so as to face the polishing surface 3*a* of the polishing pad 3 through the infrared heater 15. In one embodiment, the fan 79 may be disposed below the infrared heater 15.

The fan 79 is coupled to the controller 40, and the controller 40 can operate the fan 79. When the fan 79 is set in motion while the infrared heater 15 is driven, air around the fan 79 is sent to the polishing surface 3*a* of the polishing pad 3 as hot air. The controller 40 controls a flow velocity (i.e., air velocity) in the air sent by the fan 79 to a level of flow velocity where the polishing liquid on the polishing pad 3 is not scattered. In the embodiment shown in FIG. 15, a single fan 79 is provided, but the number of fans 79 is not limited to this embodiment. A plurality of fans 79 may be provided.

The controller 40 can control the infrared heater 15 and the fan 29 separately. Therefore, in one embodiment, the controller 40 can operate only the fan 79 without driving the infrared heater 15 based on the temperature of the polishing surface 3*a* of the polishing pad 3 measured by the pad-temperature measuring device 39. As a result, the polishing surface 3*a* of the polishing pad 3 is cooled by the air sent by the rotation of the fan 79.

Figure 16:
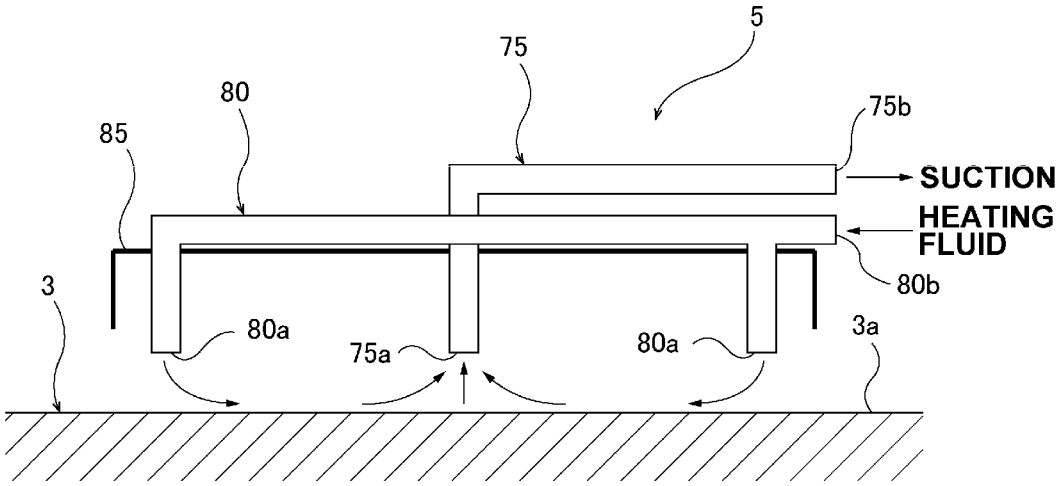
FIG. 16 is a view showing the pad-temperature regulating apparatus according to still another embodiment.
Figure 17:
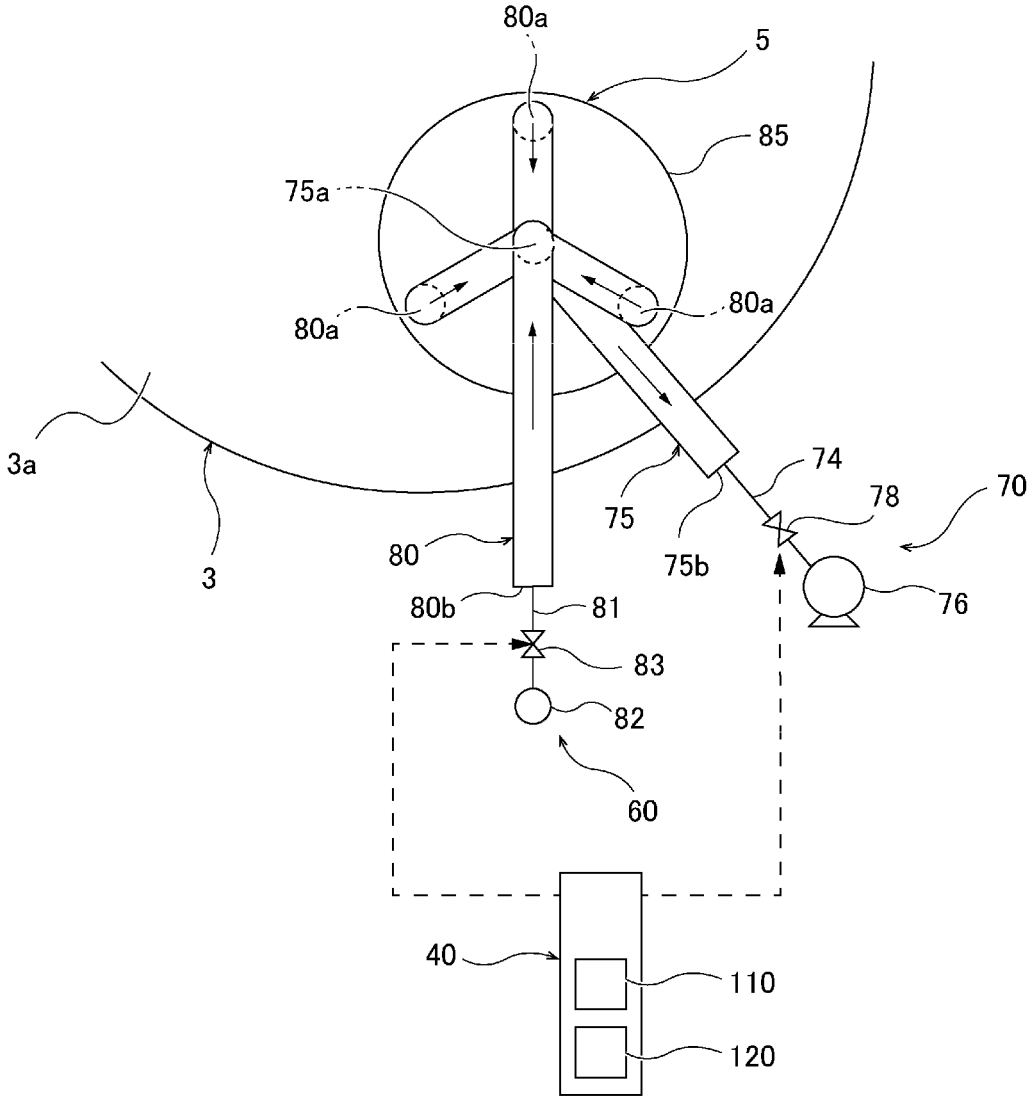
FIG. 17 is a view showing the pad-temperature regulating apparatus according to still another embodiment.

FIGS. 16 and 17 are views each showing the pad-temperature regulating apparatus according to still another embodiment. Configuration and operation of this embodiment, which is not described particularly, are the same as those of the embodiments described above, and thus duplicate descriptions thereof are omitted.

In the embodiment shown in FIGS. 16 and 17, the pad-temperature regulating apparatus 5 does not include the infrared heater 15. However, this pad-temperature regulating apparatus 5 includes instead a heating fluid nozzle 80 for jetting a heating fluid onto the polishing surface 3*a* of the polishing pad 3.

The pad-temperature regulating apparatus 5 may include a suction nozzle 75 for sucking the heating fluid supplied from the heating fluid nozzle 80. The suction nozzle 75 has the same configuration as the suction nozzle 75 according to the embodiment shown in FIG. 13. Therefore, the description of the structure of the suction nozzle 75 is omitted.

As shown in FIGS. 16 and 17, the heating fluid nozzle 80 has a plurality of supply ports 80*a* arranged around the suction port 75*a* of the suction nozzle 75 so that the heating fluid flows toward the suction port 75*a* of the suction nozzle 75.

As shown in FIG. 17, the heating fluid nozzle 80 is coupled to a heating-fluid supply source 82. More specifically, the supply port 80*a* of the heating fluid nozzle 80 is arranged above the polishing surface 3*a*, and a coupling end 80*b* of the heating fluid nozzle 80 is coupled to the heating-fluid supply source 82 through a supply line 81. A control valve 83 is disposed in the supply line 81. The heating fluid nozzle 80, the supply line 81, the heating-fluid supply source 82, and the control valve 83 constitute a heating mechanism 60. The pad-temperature regulating apparatus 5 includes the heating mechanism 60.

The controller 40 is coupled to the control valve 83. When the controller 40 opens the control valve 83, the heating fluid is supplied from the supply port 80*a* of the heating fluid nozzle 80 toward the polishing surface 3*a* of the polishing pad 3 through the supply line 81. Examples of the heating fluid may include heated gas, heated steam and superheated steam. Examples of the heated gas may include high-temperature air (i.e., hot air). The superheated steam means high temperature steam obtained by further heating saturated steam.

In the embodiment shown in FIG. 17, the three supply ports 80*a* are arranged at equal intervals so as to surround the suction port 75*a* of the suction nozzle 75. However, the number of the supply ports 80*a* is not limited to this embodiment. The number of supply ports 80*a* may be two, or may be four or more. The plurality of supply ports 80*a* may be arranged at unequal intervals so as to surround the suction port 75*a*.

As shown in FIGS. 16 and 17, the pad-temperature regulating apparatus 5 may include a heat insulating cover 85 for covering the suction port 75*a* of the suction nozzle 75 and the supply port 80*a* of the heating fluid nozzle 80.

Figure 18:
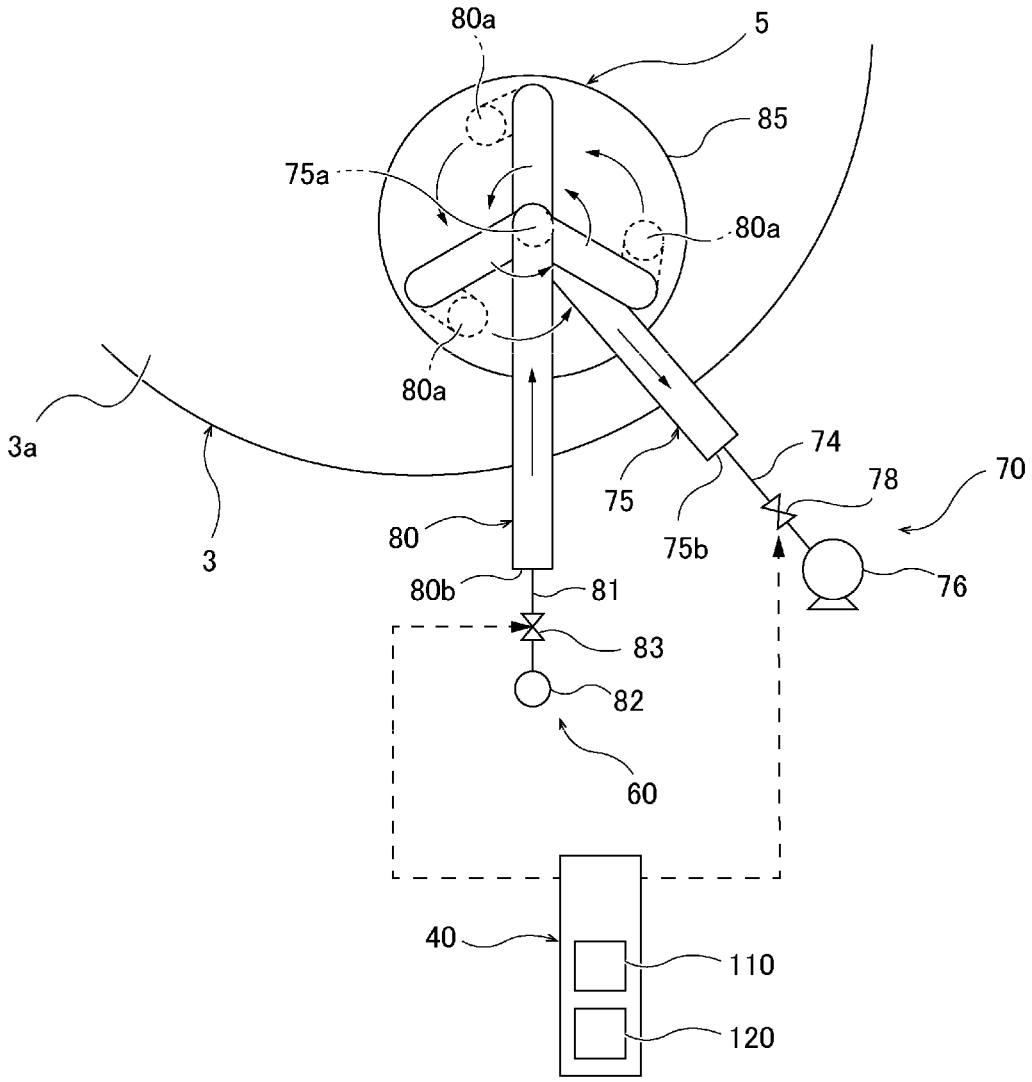
FIG. 18 is a view showing a modification of the heating fluid nozzle according to the embodiment shown in FIG. 16.

FIG. 18 is a view showing a modification of the heating fluid nozzle 80 according to the embodiment shown in FIG. 16. Each supply port 80*a* may be inclined at an angle to prevent the polishing fluid on the polishing pad 3 from scattering. In one embodiment, as shown in FIG. 18, a plurality of (three in this embodiment) supply ports 80*a* are inclined at a predetermined angle toward the suction port 75*a* of the suction nozzle 75 so that the heating fluid forms a swirling flow (see the arc-shaped arrow in FIG. 18) toward the suction port 75*a* of the suction nozzle 75. In the embodiment shown in FIG. 18, each supply port 80*a* extends along a circumferential direction of the heat insulating cover 85, and is inclined at a predetermined angle toward the suction port 75*a*.

Figure 19:
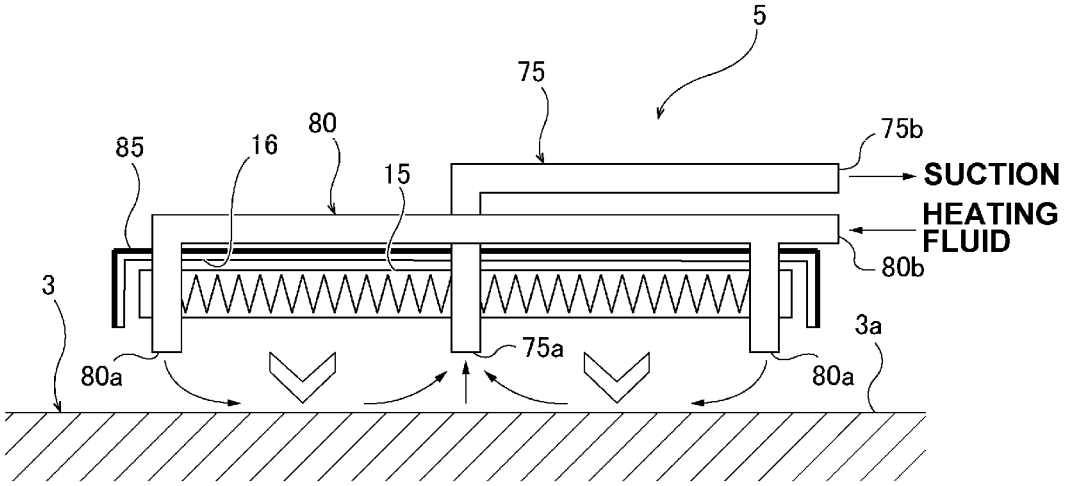
FIG. 19 is a view showing the pad-temperature regulating apparatus according to still another embodiment.

FIG. 19 is a view showing the pad-temperature regulating apparatus according to still another embodiment. As shown in FIG. 19, the embodiment shown in FIG. 13 and the embodiment shown in FIG. 16 may be combined. In the embodiment shown in FIG. 19, the reflecting plate 16 is attached to an inner surface of the heat insulating cover 85. The embodiment shown in FIG. 10 (i.e., the embodiment in which the reflecting plate 16 is not provided) and the embodiment shown in FIG. 16 may be combined.

The surface temperature of the polishing pad 3 can be changed based on the configurations described in the above-described embodiments. The controller 40 can change the surface temperature of the polishing pad 3 by employing at least one of the means, for example, a means for changing the magnitude of current supplied to the infrared heater 15, a means for changing an angle of the reflecting plate 16, a means for changing a distance between the infrared heater 15 and the polishing surface 3*a* of the polishing pad 3, a means for changing a rotation speed of the fan 79 and a means for changing an angle at which the heating fluid is applied to the polishing surface 3*a* of the polishing pad 3.

When changing the angle of the reflecting plate 16, the controller 40 may control operation of a motor (not shown) capable of changing the angle of the reflecting plate 16. When changing the distance between the infrared heater 15 and the polishing surface 3*a* of the polishing pad 3, the controller 40 may control operation of a motor (not shown) capable of changing a height of the infrared heater 15. When changing the angle at which the heating fluid is applied to the polishing surface 3*a*, the controller 40 may control operation of a motor (not shown) capable of changing the angle of the heating fluid nozzle 80.

In the embodiment shown in FIG. 11, an example in which the surface temperature of the polishing pad 3 is partially changed has been described. The surface temperature of the polishing pad 3 may be partially changed by means described below. For example, the controller 40 can change partially the temperature of the polishing surface 3*a* of the polishing pad 3 by employing at least one of a means for changing the angle of the reflecting plate 16, a means for changing an orientation angle of the infrared heater 15, and a means for changing the angle at which the heating fluid is applied.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention can be used in a polishing method and a polishing apparatus for polishing a substrate, such as a wafer, while pressing the substrate against a polishing surface of a polishing pad, and more particularly in a polishing method and a polishing apparatus for polishing a substrate while regulating a polishing load based on measurement values of a film-thickness measuring device.

REFERENCE SIGNS LIST

1 polishing head
2 polishing table
3 polishing pad
4 polishing-liquid supply nozzle
5 pad-temperature regulating apparatus
6 table motor
11 heat exchanger
15 heating device (infrared heater)
15A, 15B, 15C infrared heater
16 reflecting plate
17 cooling device
25 carrier
26 elastic membrane
30 fluid supply system
39 pad-temperature measuring device
40 controller
60 heating mechanism
70 suction mechanism
79 fan
80 heating fluid nozzle

The invention claimed is:

1. A polishing method, comprising;

pressing a substrate against a polishing surface of a polishing pad at an arbitrary pressure without controlling a polishing load for pressing the substrate against the polishing surface based on measurement values from a film-thickness measuring device which is provided in the polishing pad, while heating the polishing surface of the polishing pad until reaching a predetermined temperature by use of a pad-temperature regulating apparatus; and after the temperature of the polishing surface reaches the predetermined temperature, polishing the substrate while maintaining the temperature of the polishing surface at the predetermined temperature and controlling the polishing load based on measurement values from the film-thickness measuring device.

2. The polishing method according to claim 1, wherein the predetermined temperature is a first predetermined temperature, polishing of the substrate includes:

a first polishing in which the substrate is polished at the first predetermined temperature while controlling the polishing load based on the measurement values of the film-thickness measuring device; and a second polishing in which the substrate is polished at a second predetermined temperature different from the first predetermined temperature while controlling the polishing load based on the measurement values of the film-thickness measuring device, and switching the first polishing to the second polishing is performed when an amount of remaining film in the substrate, measured by the film-thickness measuring device, reaches a predetermined amount.

3. The polishing method according to claim 1, wherein the predetermined temperature is a first predetermined temperature, polishing of the substrate includes:

a first polishing in which the substrate is polished at the first predetermined temperature while controlling the polishing load based on the measurement values of the film-thickness measuring device; and a second polishing in which the substrate is polished at a second predetermined temperature, which is changed from the first predetermined temperature, while controlling the polishing load based on the measurement values of the film-thickness measuring device, and switching the first polishing to the second polishing is performed when an amount of remaining film in the substrate, measured by the film-thickness measuring device, reaches a predetermined amount.

4. A polishing apparatus, comprising:

a polishing table for supporting a polishing pad;

a polishing head configured to press a substrate against a surface of the polishing pad so as to polish the substrate;

a pad-temperature measuring device configured to measure a temperature of the polishing surface;

a pad-temperature regulating apparatus configured to regulate the temperature of the polishing surface;

a film-thickness measuring device mounted to the polishing table; and a controller configured to control operations of at least the polishing head and the pad-temperature regulating apparatus, wherein the controller is configured to:

press the substrate against the polishing surface at an arbitrary pressure without controlling a polishing load for pressing the substrate against the polishing surface based on measurement values from the film-thickness measuring device, while heating the polishing surface, until reaching a predetermined temperature, by use of the pad-temperature regulating apparatus based on measurement values from the pad-temperature measuring device; and after the temperature of the polishing surface reaches the predetermined temperature, polish the substrate while maintaining the temperature of the polishing surface at the predetermined temperature and controlling the polishing load based on the measurement values from the film-thickness measuring device.

5. The polishing apparatus according to claim 4, wherein the predetermined temperature is a first predetermined temperature, polishing of the substrate includes:

a first polishing in which the substrate is polished at the first predetermined temperature while controlling the polishing load based on the measurement values of the film-thickness measuring device; and a second polishing in which the substrate is polished at a second predetermined temperature different from the first predetermined temperature while controlling the polishing load based on the measurement values of the film-thickness measuring device, and the controller is configured to switch the first polishing to the second polishing when an amount of remaining film in the substrate, measured by the film-thickness measuring device, reaches a predetermined amount.

6. The polishing apparatus according to claim 4, wherein the predetermined temperature is a first predetermined temperature, polishing of the substrate includes:

a first polishing in which the substrate is polished at the first predetermined temperature while controlling the polishing load based on the measurement values of the film-thickness measuring device; and a second polishing in which the substrate is polished at a second predetermined temperature, which is changed from the first predetermined temperature, while controlling the polishing load based on the measurement values of the film-thickness measuring device, and the controller is configured to switch the first polishing to the second polishing when an amount of remaining film in the substrate, measured by the film-thickness measuring device, reaches a predetermined amount.

* * * * *